US009502016B2

(12) United States Patent
Balatti et al.

(10) Patent No.: US 9,502,016 B2
(45) **Date of Patent: *Nov. 22, 2016**

(54) ADJUSTABLE AND FOLDABLE SHOULDER REST FOR VIOLIN OR VIOLA

(71) Applicant: The Kun Shoulder Rest Inc., Ottawa (CA)

(72) Inventors: Aldo Balatti, Ottawa (CA); Marina Kun, Ottawa (CA)

(73) Assignee: THE KUN SHOULDER REST INC., Ottawa (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/948,639

(22) Filed: Nov. 23, 2015

(65) Prior Publication Data

US 2016/0133238 A1 May 12, 2016

Related U.S. Application Data

(63) Continuation of application No. 14/535,178, filed on Nov. 6, 2014.

(51) Int. Cl.

| | |
|---|---|
| ***G10G 5/00*** | (2006.01) |
| ***G10D 3/18*** | (2006.01) |
| ***G10D 1/02*** | (2006.01) |

(52) U.S. Cl.

CPC ..... *G10G 5/005* (2013.01); *G10D 1/02* (2013.01); *G10D 3/18* (2013.01)

(58) Field of Classification Search

CPC ..... G10G 5/005; G10G 5/00; G10G 7/00; G10D 3/18; G10D 3/00; G10D 1/02; A45F 2003/001

USPC ..... 84/279, 280, 327, 329

See application file for complete search history.

(56) References Cited

U.S. PATENT DOCUMENTS

| | | | |
|---|---|---|---|
| 1,756,676 | A | 4/1930 | Colbentson |
| 2,248,854 | A | 7/1941 | Frederick et al. |
| 2,489,101 | A | 11/1949 | Mills |
| 3,896,694 | A | 7/1975 | Goldner |
| 5,208,409 | A | 5/1993 | Roulet |
| 5,270,474 | A | 12/1993 | Kun |
| 5,419,226 | A | 5/1995 | Kun |
| 5,567,893 | A | 10/1996 | Kun |

(Continued)

OTHER PUBLICATIONS

Extended European Search Report issued in connection with European Patent Application No. 14194532.9, dated Apr. 5, 2016. (9 pages).

*Primary Examiner* — Kimberly Lockett

(74) *Attorney, Agent, or Firm* — Thomas C. McDonough; Neal, Gerber & Eisenberg LLP

(57) ABSTRACT

An adjustable and foldable shoulder rest for a violin or viola includes a shoulder-engaging body having first and second foldable forks at first and second ends of the body for attaching to the violin or viola, first and second slidable end members for supporting the first and second forks, the first and second slidable end members being slidable between retracted and extended position. In the extended position, the end member is cantilevered beyond its respective slot. The shoulder rest may have a foam cushion with openings attached to the shoulder-engaging side of the shoulder rest. The end members may define rotational housings for receiving respective rotatable drums that receive threaded stems of the forks, thereby enabling the height of the forks to be adjusted and further enabling the forks to fold.

17 Claims, 46 Drawing Sheets

(56) References Cited

U.S. PATENT DOCUMENTS

| | | | |
|---|---|---|---|
| 5,731,531 | A | 3/1998 | Kun |
| D394,481 | S | 5/1998 | DeLisse |
| 6,031,163 | A | 2/2000 | Cullum et al. |
| 6,291,750 | B1 | 9/2001 | Farha |
| 6,369,303 | B1 | 4/2002 | Hvezda |
| 6,680,431 | B2 | 1/2004 | Vanden et al. |
| 7,265,284 | B2 | 9/2007 | Muir et al. |
| 7,385,124 | B2 | 6/2008 | Clemente |
| D631,276 | S | 1/2011 | White |
| 8,550,843 | B2 | 10/2013 | Van Swearingen |
| D748,321 | S | 1/2016 | Grimm et al. |
| D753,253 | S | 4/2016 | Chiu |
| 2005/0120860 | A1 | 6/2005 | Chen |
| 2005/0282691 | A1 | 12/2005 | Hakooz |
| 2006/0174743 | A1 | 8/2006 | Clemente |

ADJUSTABLE AND FOLDABLE SHOULDER REST FOR VIOLIN OR VIOLA

CROSS-REFERENCE TO RELATED APPLICATION

This application is a continuation of U.S. patent application Ser. No. 14/535,178 which was filed on Nov. 6, 2014 entitled ADJUSTABLE AND FOLDABLE SHOULDER REST FOR VIOLIN OR VIOLA; which is incorporated herein by reference in its entirety.

TECHNICAL FIELD

The present invention relates generally to shoulder rests for violins or violas.

BACKGROUND

A shoulder rest is an accessory device that can be attached to a violin or viola. Typically, the shoulder rest has fork-shaped clamping members or "feet" for detachably mounting the shoulder rest to the sides of the back of the violin or viola. The shoulder rest spaces the instrument at a comfortable height for the musician. The shoulder rest may have a body profile that generally conforms to the natural curves of the human shoulder and clavicle.

To accommodate both instruments of different sizes and musicians' body structures and posture preferences, some shoulder rests are adjustable in height and distance between the fork-shaped clamping members.

Some examples of adjustable shoulder rests are disclosed in U.S. Pat. No. 5,270,474 (Kun) entitled "Violin or the Like Shoulder Rest", U.S. Pat. No. 5,419,226 (Kun) entitled "Violin Shoulder Rest", U.S. Pat. No. 5,567,893 (Kun) entitled "Shoulder Rest for Violin or Like Instrument", U.S. Pat. No. 6,031,163 (Cullum et al.) entitled "Adjustable Shoulder Rest for Violins or the Like", U.S. Pat. No. 7,265,284 (Muir et al) entitled "Violin or the Like Instrument" which are all incorporated herein by reference.

To permit more compact storage, some shoulder rests are foldable (or "collapsible") such as the one disclosed in U.S. Pat. No. 5,731,531 (Kun) entitled "Shoulder Rest for Violin or Like Instrument" which is incorporated herein by reference.

The body or bridge of the shoulder rest may be made of different materials such as polymers, composite materials, metals, or woods. U.S. Pat. No. 6,291,750 (Farha) entitled "Bridge for a Violin or Viola Shoulder Rest", which is incorporated herein by reference, discloses a body or bridge made of a laminate that includes a plurality of wood veneers.

Other improvements in shoulder rest ergonomics are disclosed in U.S. Pat. No. 7,385,124 (Clemente) entitled "Clamping Member for a Violin Shoulder Rest" which is incorporated herein by reference.

Although adjustable and foldable shoulder rests are known in the art, further improvements in adjustability and ergonomics remain highly desirable.

SUMMARY

The present invention provides a novel shoulder rest that is adjustable and foldable. The shoulder rest includes two independently operable pull-tab adjustment mechanisms for independently adjusting, i.e. extending or retracting, the foldable forks. On its shoulder-engaging side, the shoulder rest has a foam cushion with openings. The forks of the shoulder rest are rotationally mounted to drums encapsulated with slidable end members. Other features and aspects of the invention are described below in the detailed description and are illustrated in the accompanying drawings.

Accordingly, one inventive aspect of the present disclosure is an adjustable and foldable shoulder rest for a violin or viola. The shoulder rest comprises a shoulder-engaging body having a first end and a second end, the body also having a shoulder-engaging side and an instrument-facing side. The shoulder rest comprises a first foldable fork-shaped clamping member disposed at the first end for clamping the violin or viola, wherein the clamping member is foldable from an engaged position to a folded position. The shoulder rest comprises a second foldable fork-shaped clamping member disposed at a second end for clamping the violin or viola wherein the clamping member is foldable from an unfolded position to a folded position. The shoulder rest comprises a first slidable end member for receiving a threaded stem that supports the first clamping member, the first slidable end member being slidable between a retracted position and an extended position, the first slidable end member also having an arcuate channel through which the stem rotates as the clamping member is pivoted between the unfolded and folded positions, wherein the first slidable end member is slidable within a first slot in the instrument-facing side of the body to extend or retract the first clamping member. The shoulder rest comprises a second slidable end member for supporting the second clamping member, the second slidable end member being slidable between a retracted position and an extended position, the second slidable end member also having an arcuate channel through which the stem rotates as the clamping member is pivoted between the unfolded and folded positions, wherein the second slidable end member is slidable within a second slot in the instrument-facing side of the body to extend or retract the second clamping member. The first slidable end member comprises a first protrusion shaped to engage one of a first plurality of apertures disposed in the first slot and the second slidable end member comprises a second protrusion shaped to engage one of a second plurality of apertures disposed in the second slot.

Another inventive aspect of the present disclosure is a shoulder rest for a bowed string instrument, the shoulder rest comprising a shoulder-engaging body having a shoulder-engaging side and an instrument-facing side, a first foldable fork for attaching to the instrument, wherein the fork is foldable from an unfolded position to a folded position, and a second foldable fork for attaching to the instrument wherein the fork is foldable from an unfolded position to a folded position. The shoulder rest comprises a first slidable end member for receiving a stem that supports the first fork, the first slidable end member being slidable between a retracted position and an extended, cantilevered position, the first slidable end member also having an arcuate channel through which the stem rotates as the fork is pivoted between the unfolded and folded positions, wherein the first slidable end member is slidable within a first slot in the instrument-facing side of the body to extend or retract the first fork. The shoulder rest comprises a second slidable end member for supporting the second fork, the second slidable end member being slidable between a retracted position and an extended, cantilevered position, the second slidable end member also having an arcuate channel through which the stem rotates as the fork is pivoted between the unfolded and folded positions, wherein the second slidable end member is slidable within a second slot in the instrument-facing side of the body to extend or retract the second fork. The first slidable end member comprises a first protrusion adapted to engage one of a first plurality of apertures disposed in the first slot. The second slidable end member comprises a second protrusion adapted to engage one of a second plurality of apertures disposed in the second slot.

Yet another inventive aspect of the present disclosure is a shoulder rest for a violin or viola, the shoulder rest comprising a shoulder-engaging body having a first end and a second end, the body also having a shoulder-engaging side and an instrument-facing side, a first foldable fork attachable to the violin or viola and foldable from an unfolded position to a folded position, and a second foldable fork attachable to the violin or viola and foldable from an unfolded position to a folded position. The shoulder rest includes a first slidable end member for receiving a threaded stem that supports the first fork, the first slidable end member being slidable between a retracted position and an extended position, the first slidable end member also having an arcuate channel through which the stem rotates as the first fork is pivoted between the unfolded and folded positions, wherein the first slidable end member is slidable within a first slot in the instrument-facing side of the body to extend or retract the first fork. The shoulder rest further includes a second slidable end member for supporting the second fork, the second slidable end member being slidable between a retracted position and an extended position, the second slidable end member also having an arcuate channel through which the stem rotates as the second fork is pivoted between the unfolded and folded positions, wherein the second slidable end member is slidable within a second slot in the instrument-facing side of the body to extend or retract the fork. The shoulder rest further includes a foam cushion disposed on the shoulder-engaging side. The foam cushion may comprise an optional plurality of openings.

Yet another inventive aspect of the present disclosure is a shoulder rest for a violin or viola, the shoulder rest comprising a shoulder-engaging body having a first end and a second end, the body also having a shoulder-engaging side and an instrument-facing side, a first foldable fork attachable to the violin or viola and foldable from an unfolded position to a folded position, and a second foldable fork attachable to the violin or viola and foldable from an unfolded position to a folded position. The shoulder rest comprises a first slidable end member for receiving a threaded stem that supports the first fork, the first slidable end member being slidable between a retracted position and an extended position, the first slidable end member also having an arcuate channel through which the stem rotates as the first fork is pivoted between the unfolded and folded positions, wherein the first slidable end member is slidable within a first slot in the instrument-facing side of the body to extend or retract the first fork. The shoulder rest includes a first rotatable drum encapsulated within a rotational housing of the first slidable end member. The shoulder rest includes a second slidable end member for supporting the second fork, the second slidable end member being slidable between a retracted position and an extended position, the second slidable end member also having an arcuate channel through which the stem rotates as the second fork is pivoted between the unfolded and folded positions, wherein the second slidable end member is slidable within a second slot in the instrument-facing side of the body to extend or retract the fork. The shoulder rest includes a second rotatable drum encapsulated within a rotational housing of the second slidable end member.

This summary is provided to highlight certain significant inventive aspects but is not intended to be an exhaustive or limiting definition of all inventive aspects of the disclosure. Other inventive aspects may be disclosed in the detailed description and drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
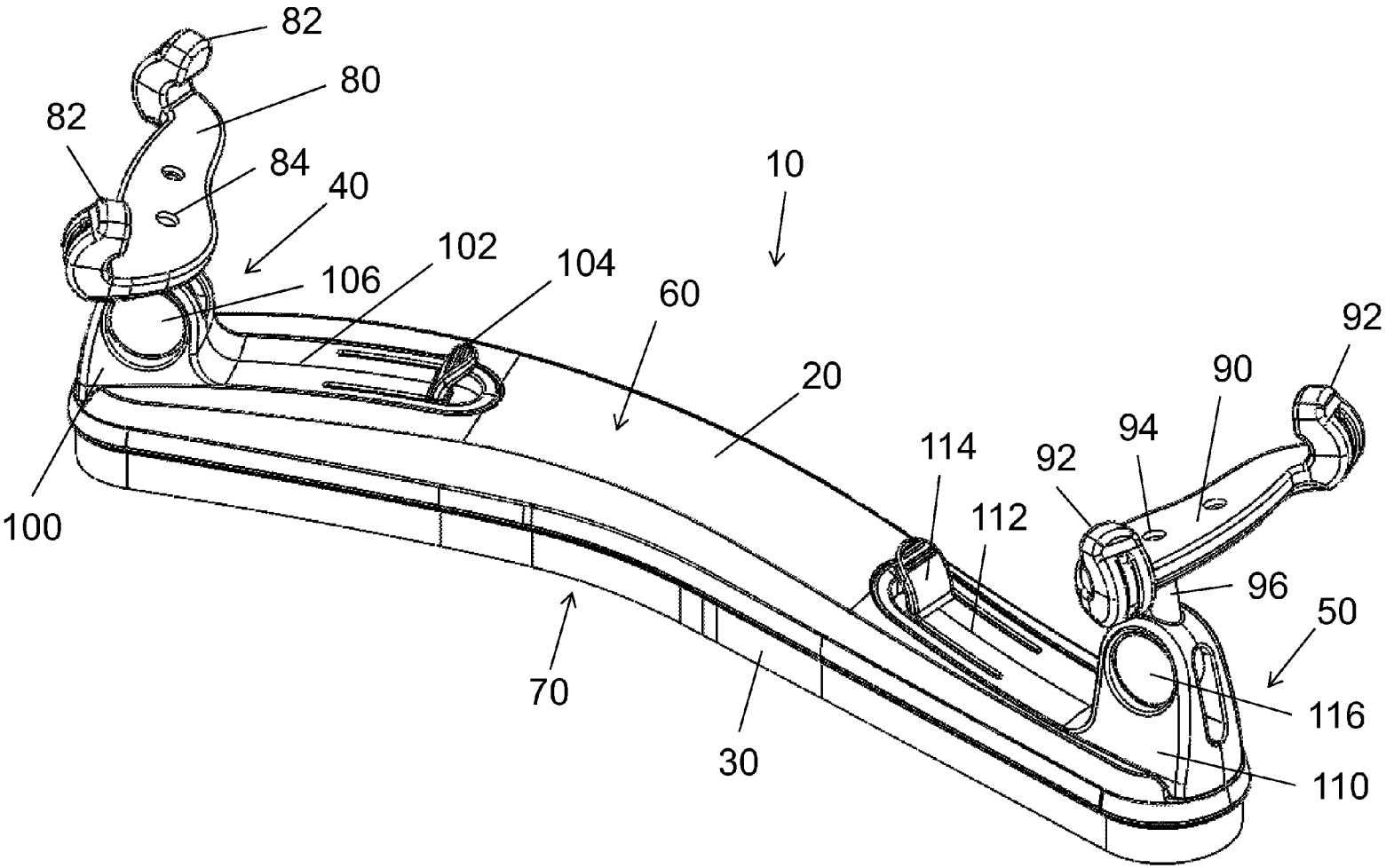
FIG. 1 is an isometric view of one embodiment of the shoulder rest in a retracted position.

FIG. 1 depicts an adjustable and foldable shoulder rest for a violin or viola in accordance with an embodiment of the present invention. The shoulder rest, which is denoted by reference numeral 10, includes a shoulder-engaging body (or "bridge") 20 and a foam cushion or pad 30. The body (bridge) 20 has a first end 40 and a second end 50. The body 20 has an instrument-facing side 60 and a shoulder-engaging side 70. A first foldable fork-shaped clamping member (or "fork") 80 having a pair of tines, prongs or fingers 82 is disposed at the first end of the body for clamping the violin or viola. The fork has a hole 84 for receiving a threaded stem. The clamping member (or fork) is foldable from an unfolded position to a folded position. A second foldable fork-shaped clamping member (or fork) 90 having a pair of tines, fingers or prongs 92 is disposed at a second end of the body/bridge for clamping the violin or viola. The second fork 90 has a hole 94 for receiving a threaded stem 96. The second clamping member (second fork) is also foldable from an unfolded position to a folded position.

Figure 2:
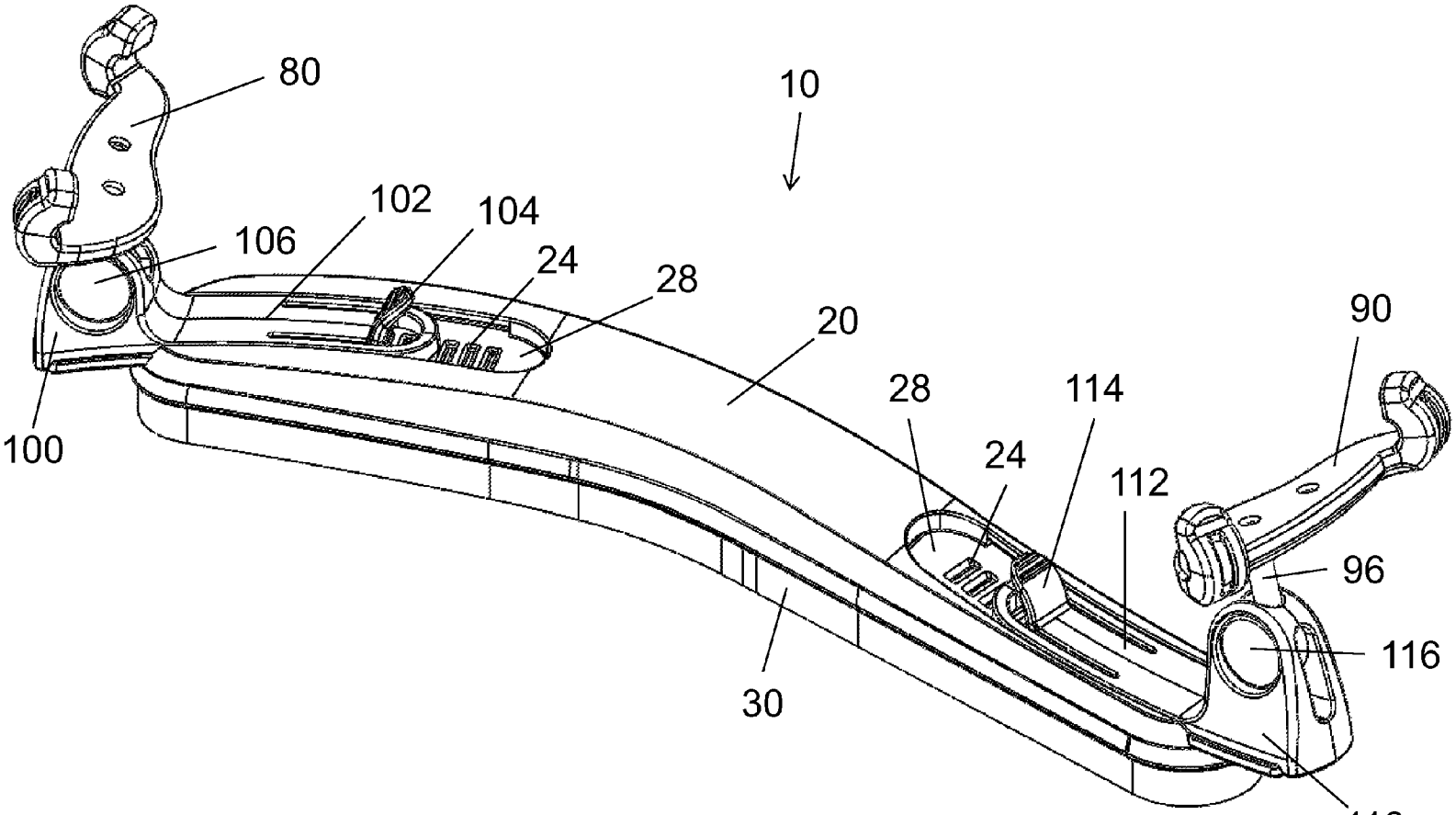
FIG. 2 is an isometric view of the shoulder rest in an extended position.

The shoulder rest 10 depicted in FIG. 1 is adjustable to increase or decrease the distance between the forks 80, 90. The shoulder rest 10 includes a pair of adjustment mechanisms to adjust the distance between the forks. Each adjustment mechanism in the shoulder rest of FIG. 1 includes a slidable end member 100, 110 having respective pull-tab adjustable sliders 102, 112 actuated by lifting pull tabs 104, 114. The adjustment mechanism enables the slidable end members (shoulder end member 100 and clavicle end member 110) to slide in slots relative to the base 20. In this manner the end members 100, 110 may be extended or retracted. In FIG. 1 the end members 100, 110 are shown fully retracted. FIG. 2 shows the end members 100, 110 partially extended. When partially or fully extended, the end members 100, 110 are also said to be cantilevered as shown in FIG. 2. The slidable end members 100, 110 have encapsulated drums 106, 116 that rotationally support the forks as will be described in greater detail below.

FIG. 2 also depicts the slidable end members sliding in respective slots. A tongue-shaped slider 102 comprises on its underside a protrusion shaped to engage one of a first plurality of apertures 24, e.g. transverse grooves, that are formed in the slot 28.

Figure 3:
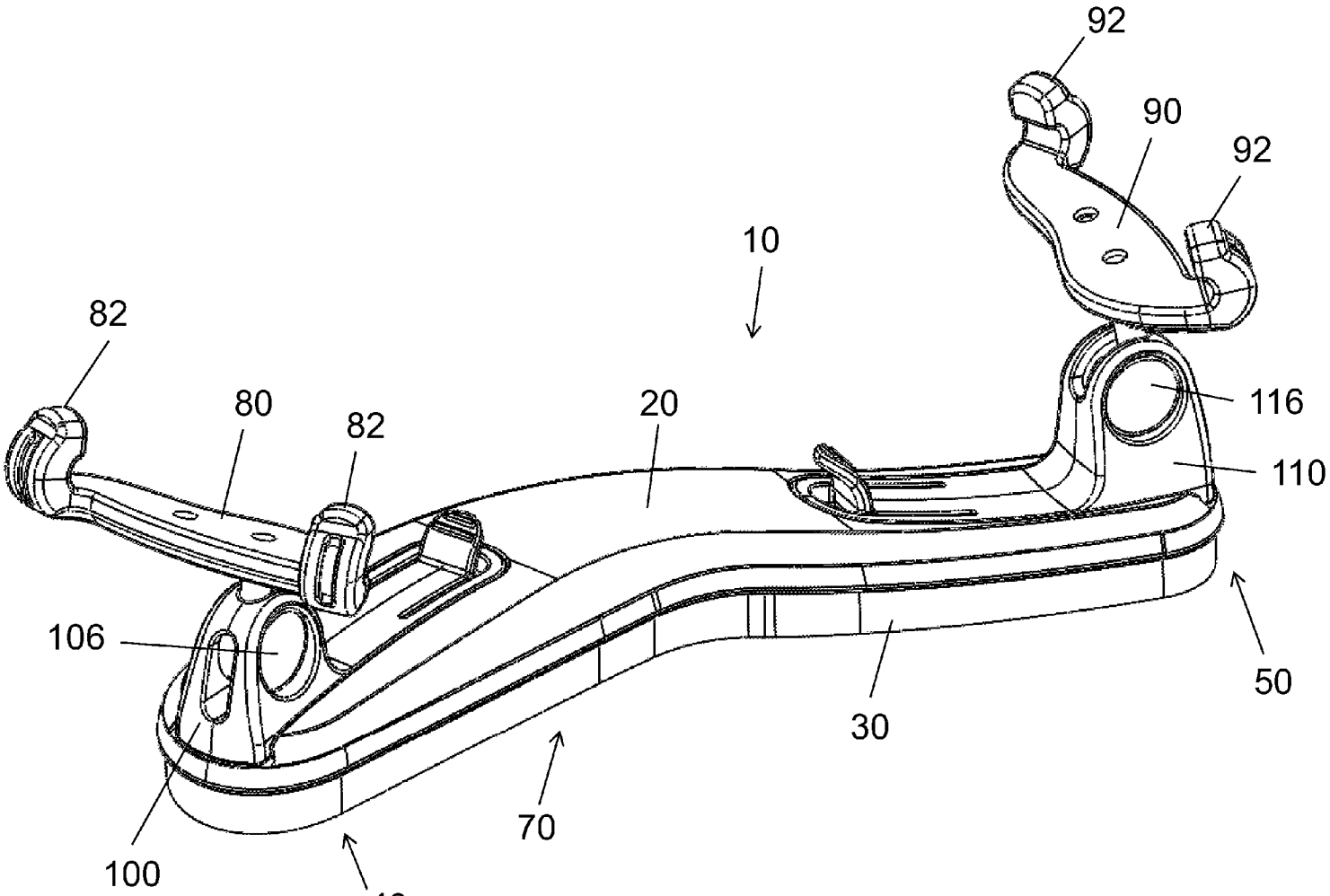
FIG. 3 is another isometric view of the shoulder rest in the retracted position.
Figure 4:
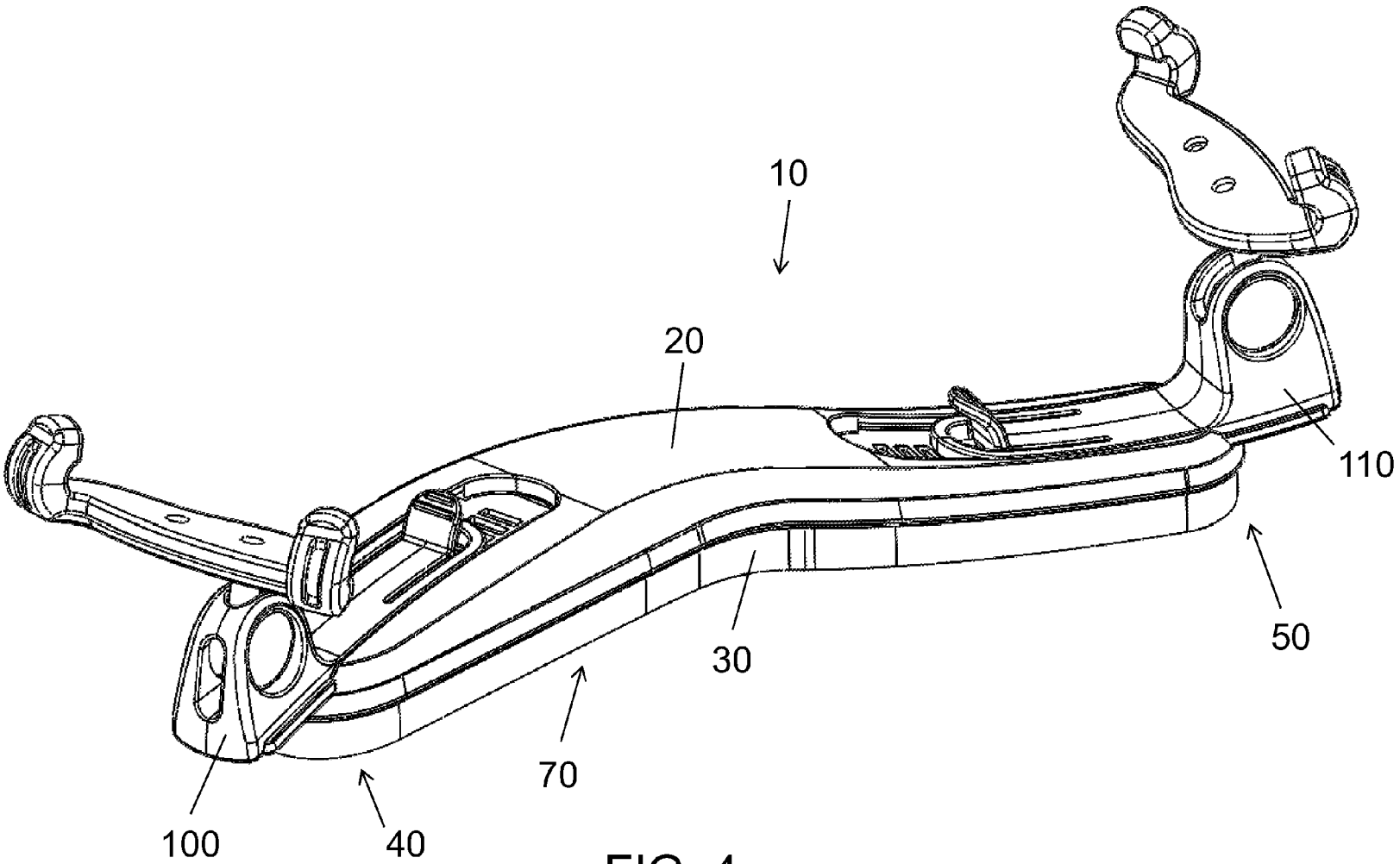
FIG. 4 is another isometric view of the shoulder rest in the extended position.

FIGS. 3 and 4 depict (from another perspective) the shoulder rest 10 in both retracted and extended postures, respectively. For the purposes of this specification, the first end 40 is also referred to as the "shoulder end" and the second end 50 is also referred to as the "clavicle end". The shoulder end is not to be confused with the shoulder-engaging side 70. The shoulder-engaging side contacts the musician's shoulder, i.e. the musician rests on the shoulder-engaging side to thus provide the shoulder rest. The shoulder end and clavicle end instead refer to the slidable end members 100, 110 (also known as "slidable support members").

Figure 5:
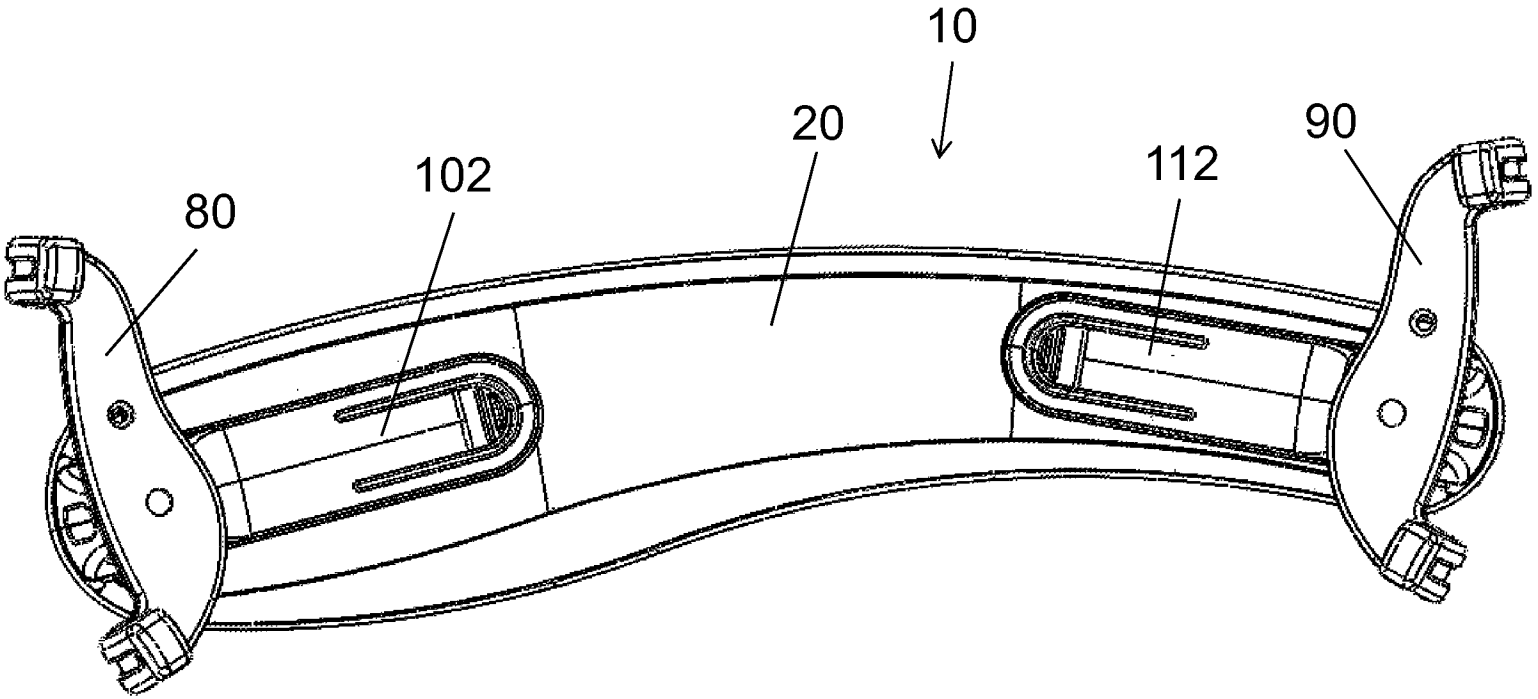
FIG. 5 is a top view of the shoulder rest in the retracted position.
Figure 6:
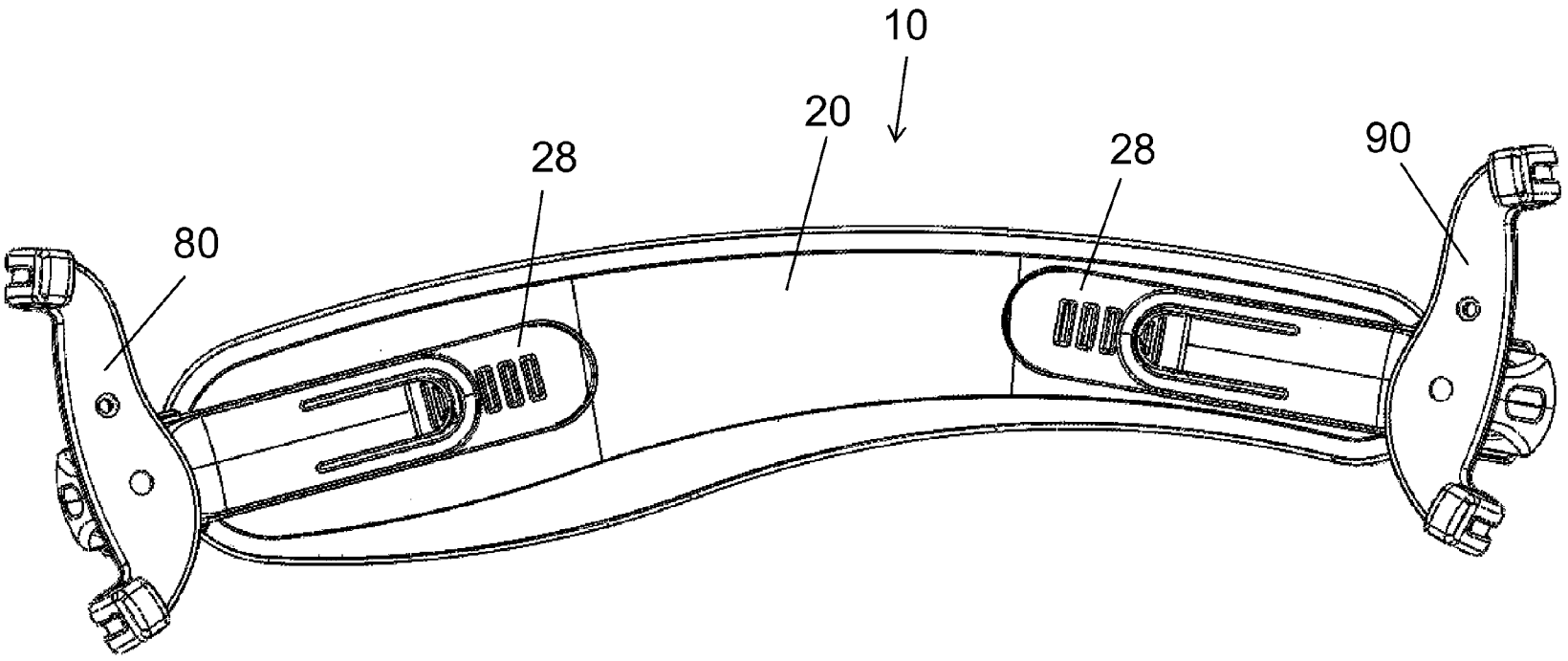
FIG. 6 is a top view of the shoulder rest in the extended position.

As depicted in FIGS. 1-6, the body (bridge) 20 is asymmetrical. Viewed from above in FIGS. 5-6, the body curves laterally (i.e. bends to one side) while the width generally increases from the clavicle end toward the shoulder end, except for a rounding off at the shoulder end. Likewise, when viewed from above in FIG. 6, it is apparent that the slots 28 or slide paths are at an angle relative to each other (i.e. they are not parallel or aligned with each other). Accordingly, the tongue-shaped sliders 102, 112 are not parallel or aligned with each other as shown in FIG. 5.

Figure 7:
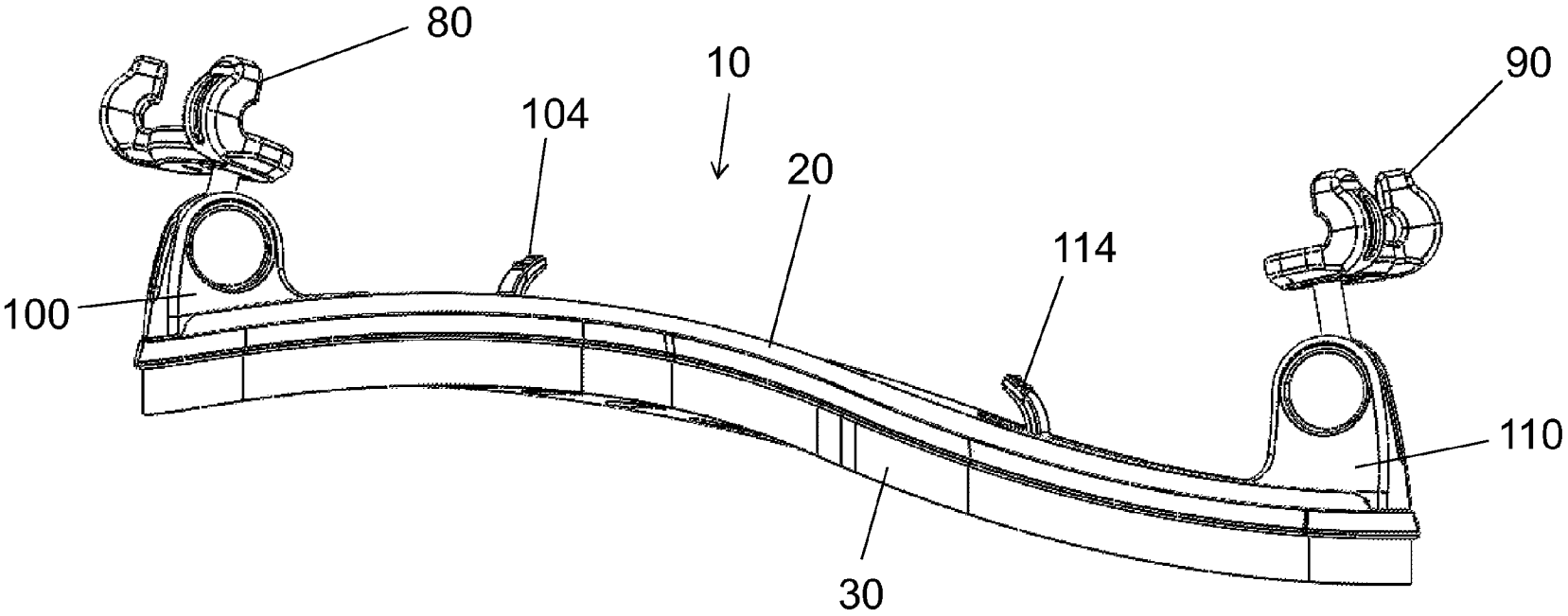
FIG. 7 is a side view of the shoulder rest in the retracted position.
Figure 8:
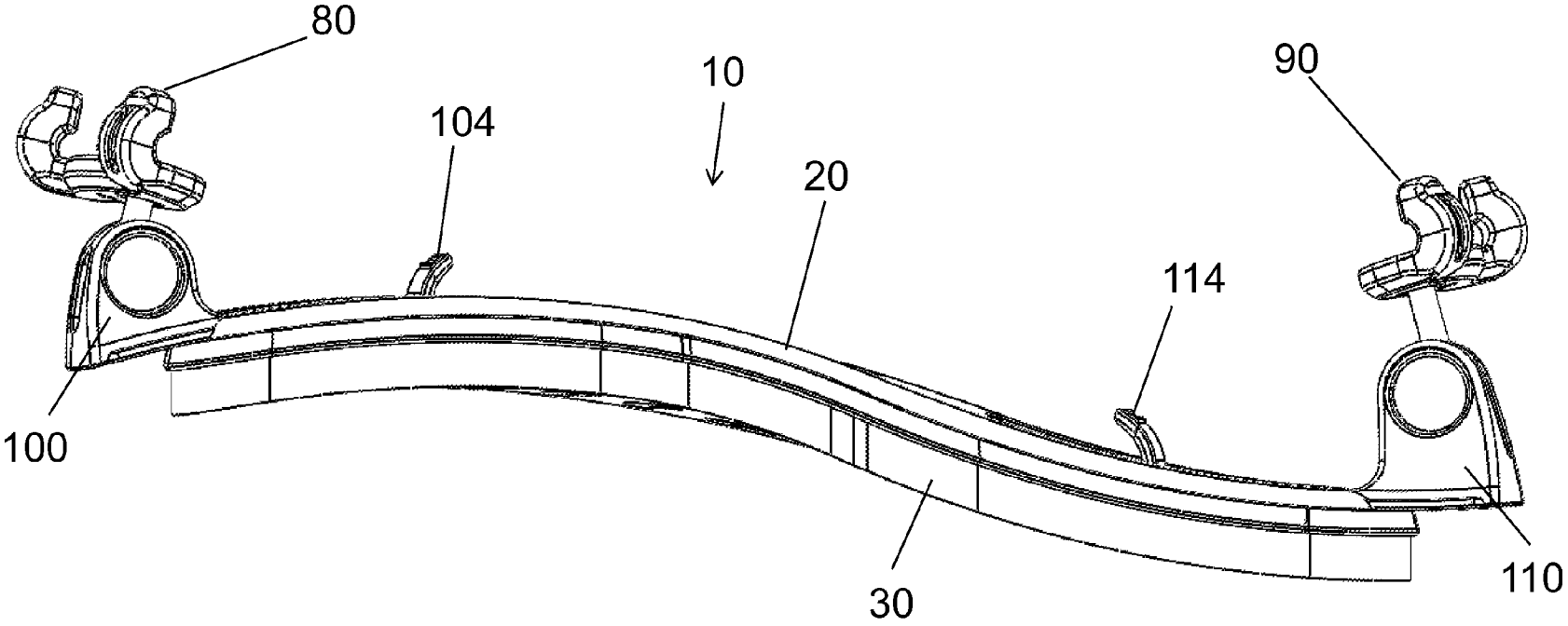
FIG. 8 is side view of the shoulder rest in the extended position.

As illustrated in FIGS. 7-8, the shoulder end member 100 is shorter in height than the clavicle end member 110. Viewed from the side in FIGS. 7-8, the body 20 curves upwardly from the clavicle end to the shoulder end. The shoulder end is convex and the clavicle end is concave as shown in FIGS. 7-8. The shoulder end member is convex to match the curvature of the convex shoulder end. The clavicle end member is concave to match the curvature of the concave clavicle end. More specifically, the first slot at the shoulder end is convex whereas the second slot at the clavicle end is concave. The sliding movement of the shoulder end member follows an arcuate generally convex path. The sliding movement of the clavicle end member follows an arcuate generally concave path. When viewed from the side in FIGS. 7-8, it is apparent that these paths are at an angle relative to each other (i.e. they are not parallel or aligned).

As further illustrated in FIGS. 7-8, the forks 80, 90 are preloaded so that they clamp or grip the violin or viola with a desired gripping or clamping force. The angle of pitch of the forks determines the amount of preload. The angle of the fork changes (i.e. opens) when the forks are mounted to the violin or viola. In other words, when attached to the instrument, the angle of the forks is greater (more "open") relative to their unattached posture. This angle of pitch varies as the forks are extended or retracted relative to the body.

Because the tongue-shaped sliders slide in the recessed slots, the sliders are flush with the body 20 as can be seen in FIGS. 7-8. In other words, the top curved surfaces of the sliders of each of the end members 100, 110 is flush with the base member 20 for an embellished appearance.

Figure 9:
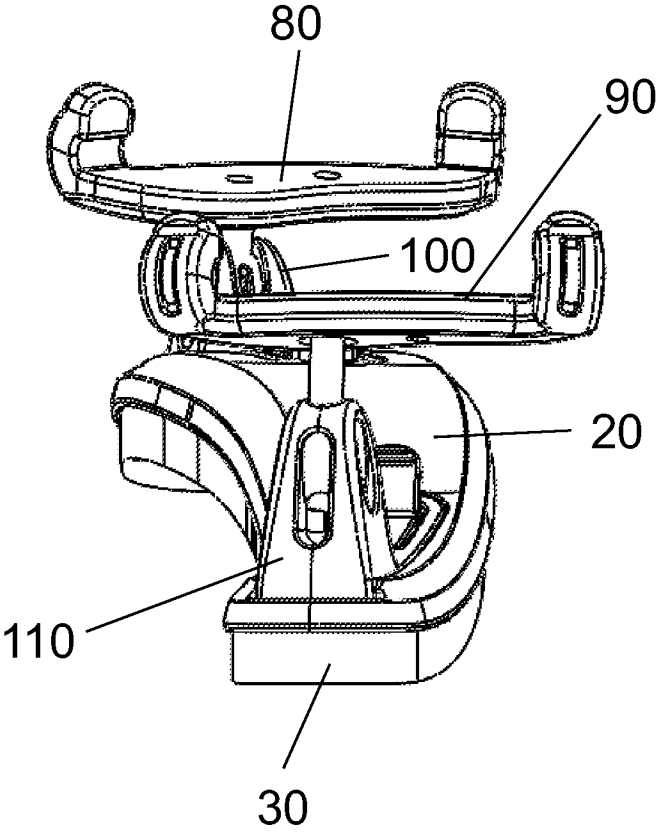
FIG. 9 is an end view of the shoulder rest in the retracted position.
Figure 10:
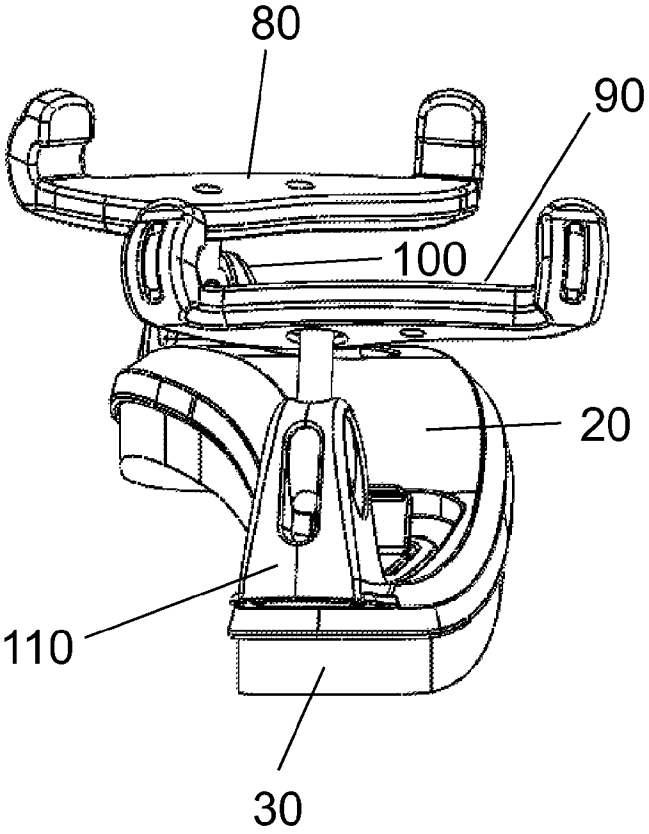
FIG. 10 is another end view of the shoulder rest in the extended position.

FIGS. 9-10 also show how the body 20 curves upwardly and to the left from the clavicle end to the shoulder end.

In the embodiment illustrated in FIGS. 11-15, the shoulder rest 10 further comprises a foam cushion or pad 30 attached to the instrument-facing side of the body (bridge) to provide a cushioned or padded shoulder rest.

As depicted in FIGS. 11-15, 18 and 21, the foam cushion 30 may optionally include a plurality of apertures, openings or holes 32. The openings 32 may be die-cut or manufactured using another technique. The foam cushion with openings provides a number of advantages. The openings make the foam cushion lighter. The openings provide more traction on the shoulder to prevent the shoulder rest from slipping on the shoulder. In other words, the openings provide an enhanced grip. The openings in the cushion also embellish the appearance of the shoulder rest. The cushion may be made of NBS, neoprene (polychloroprene) or other equivalent synthetic rubbers, sponges or foams. The openings may be elongated openings as shown in the figures. The openings may be elongated and curved, with the curvature increasing from the ends towards the middle. Other shapes and sizes of openings may be substituted.

Figure 11:
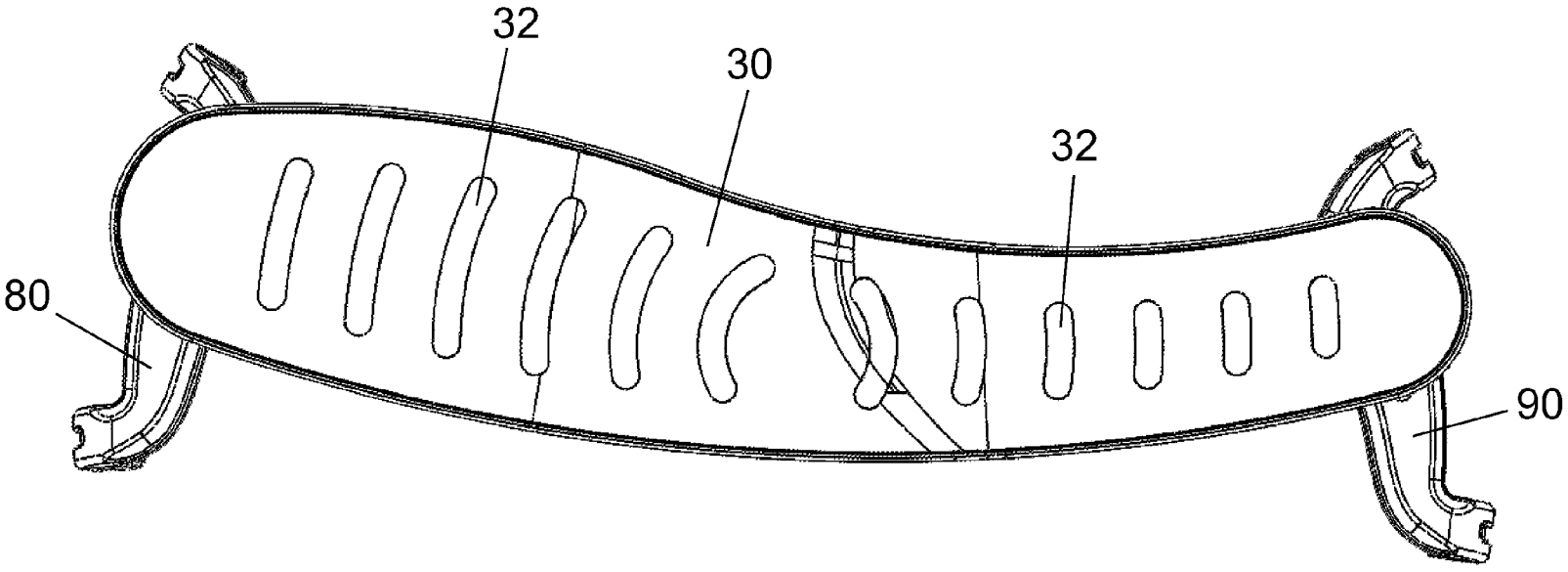
FIG. 11 is a bottom view of the shoulder rest in the retracted position.
Figure 12:
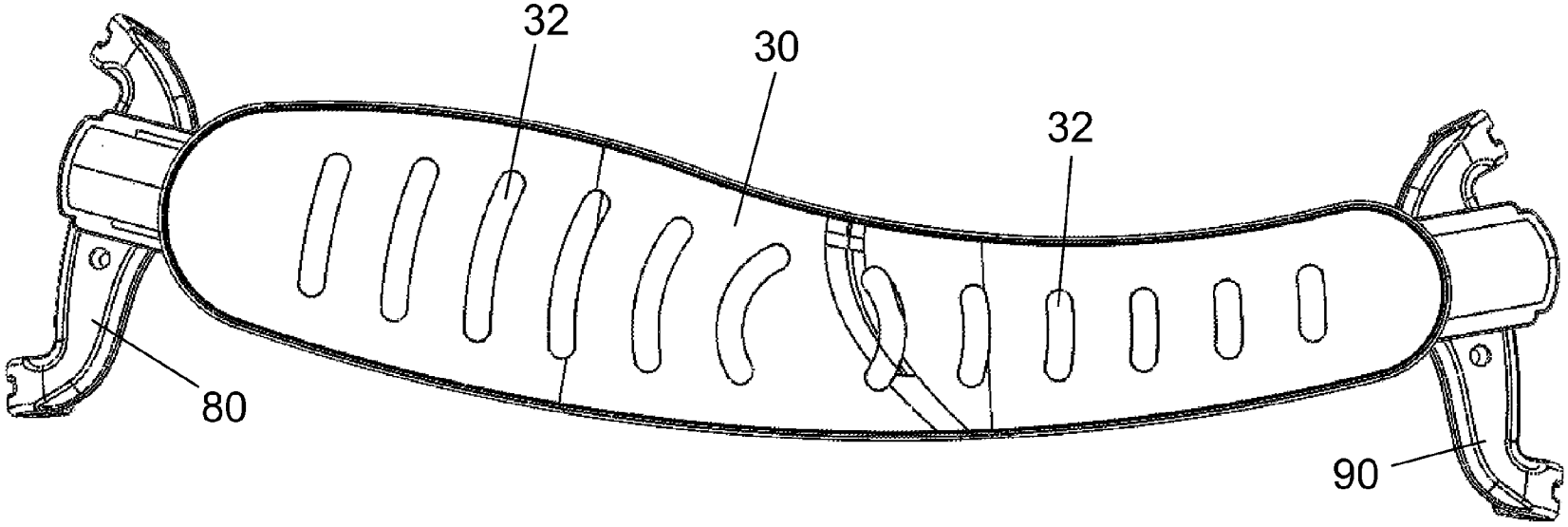
FIG. 12 is a bottom view of the shoulder rest in the extended position.
Figure 13:
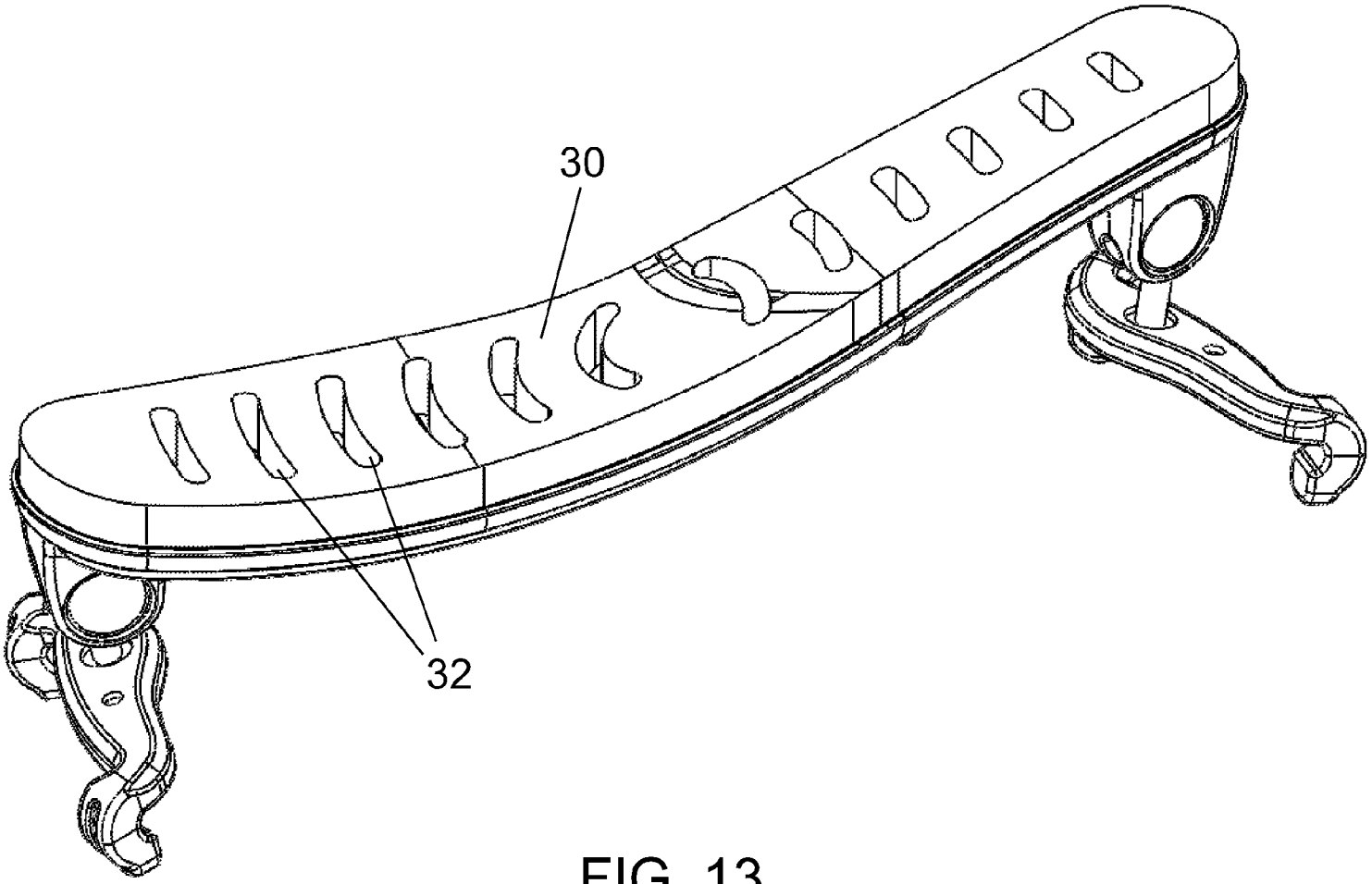
FIG. 13 is an isometric view of the shoulder rest in the retracted position, shown with the shoulder-engaging cushion facing upwardly.
Figure 14:
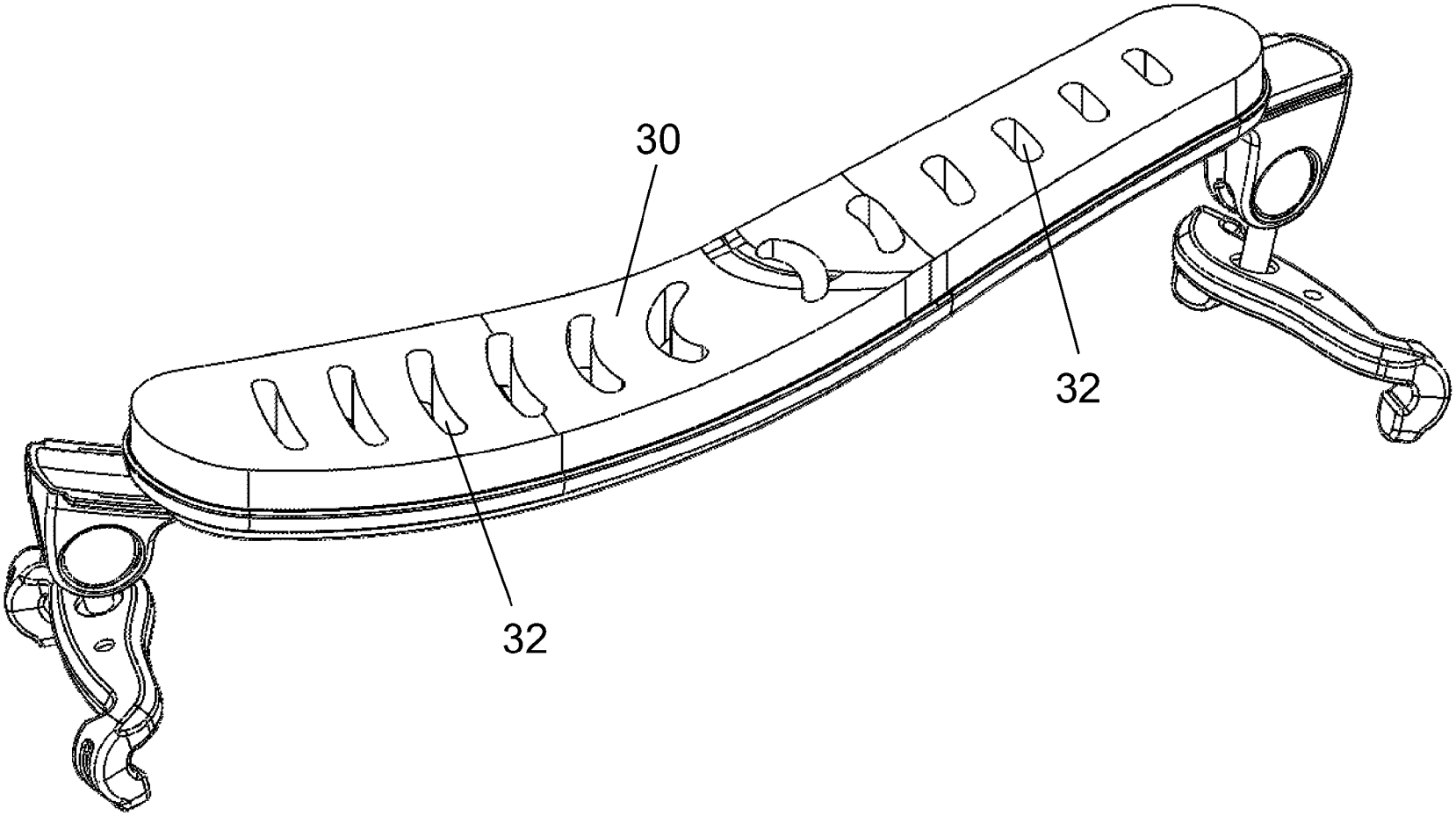
FIG. 14 is another isometric view of the shoulder rest in the extended position.
Figure 15:
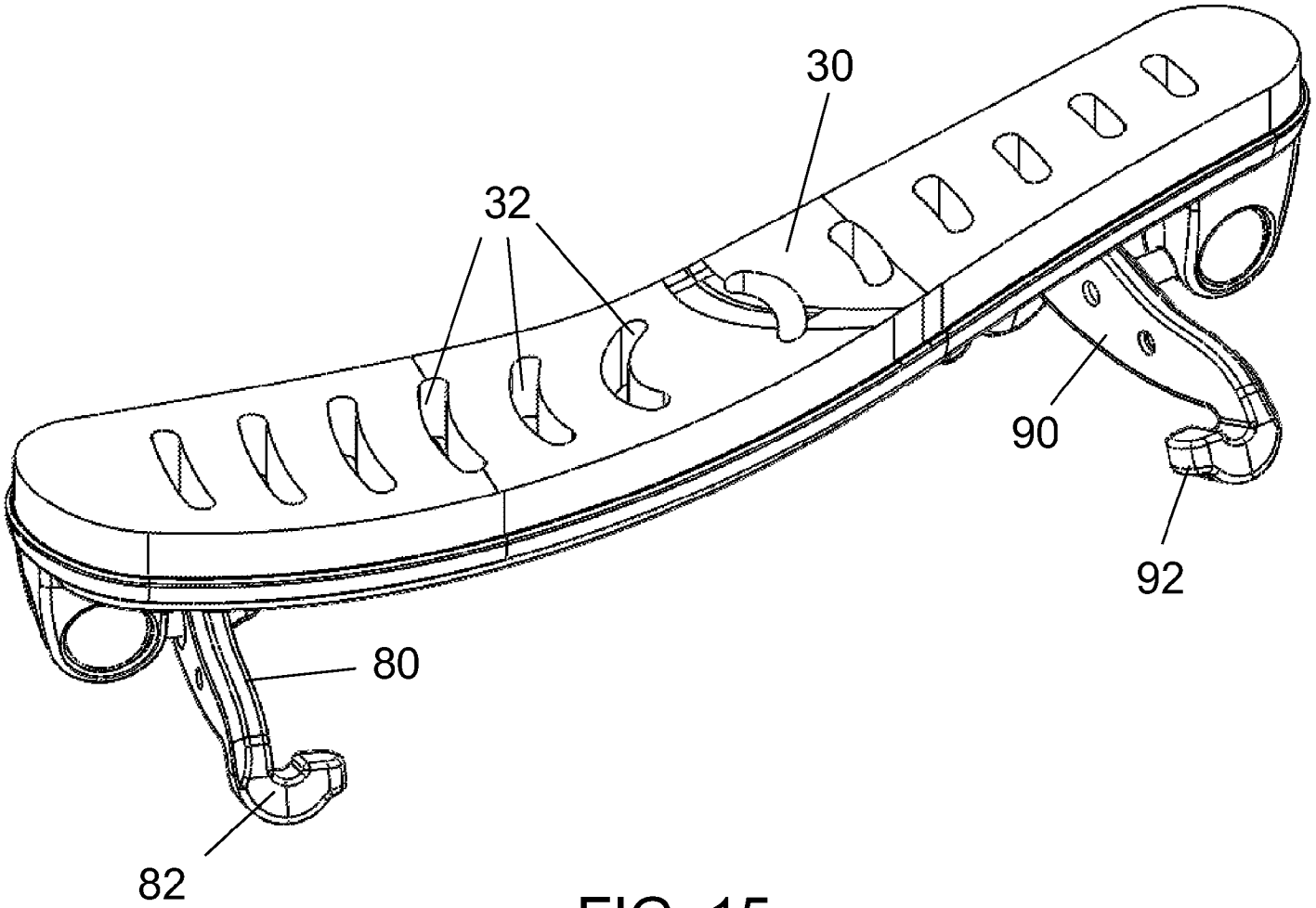
FIG. 15 is another isometric view of the shoulder rest in the folded position.
Figure 16:
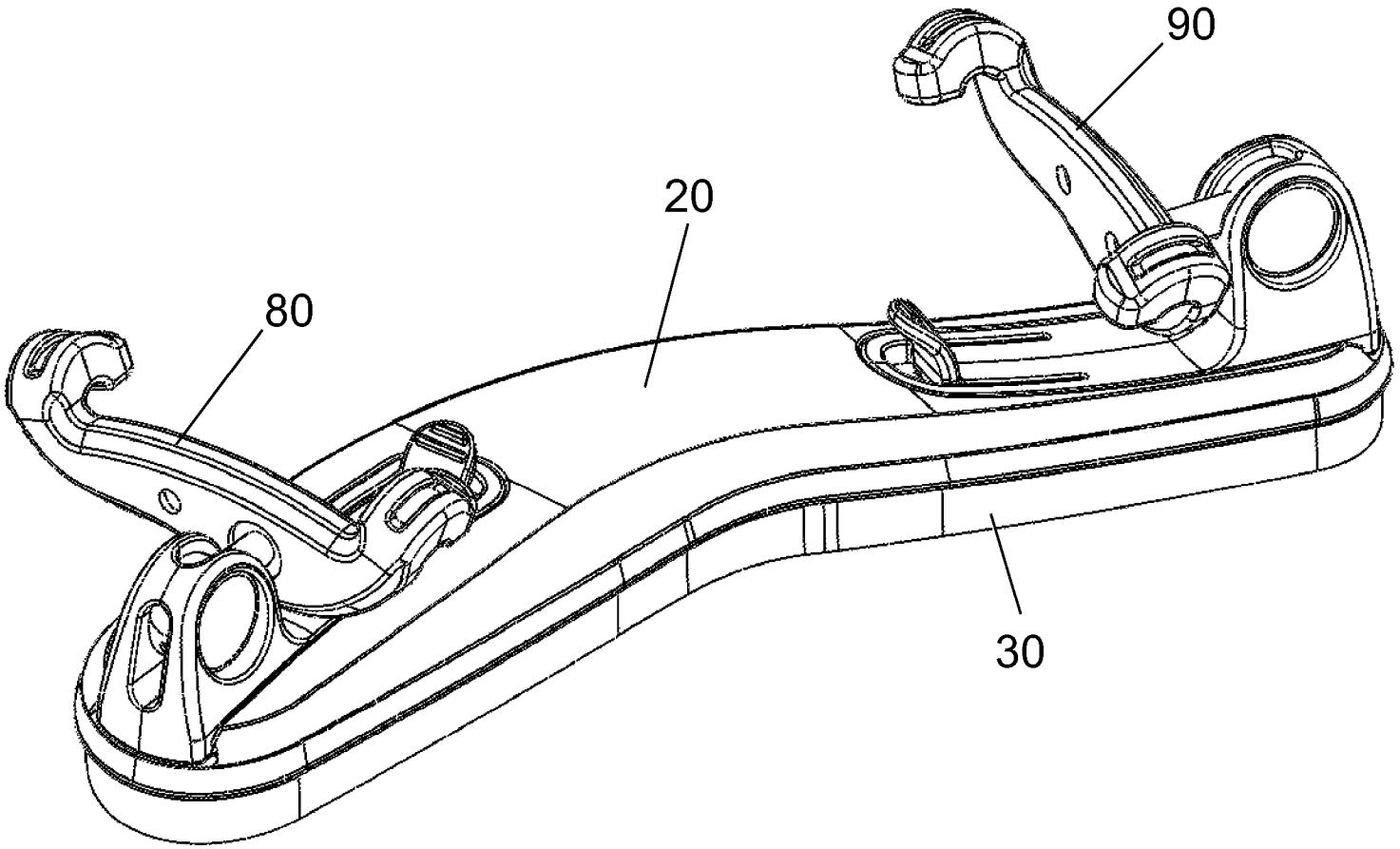
FIG. 16 is an isometric view of the shoulder rest in the folded position, shown with the instrument-facing side facing upwardly.
Figure 17:
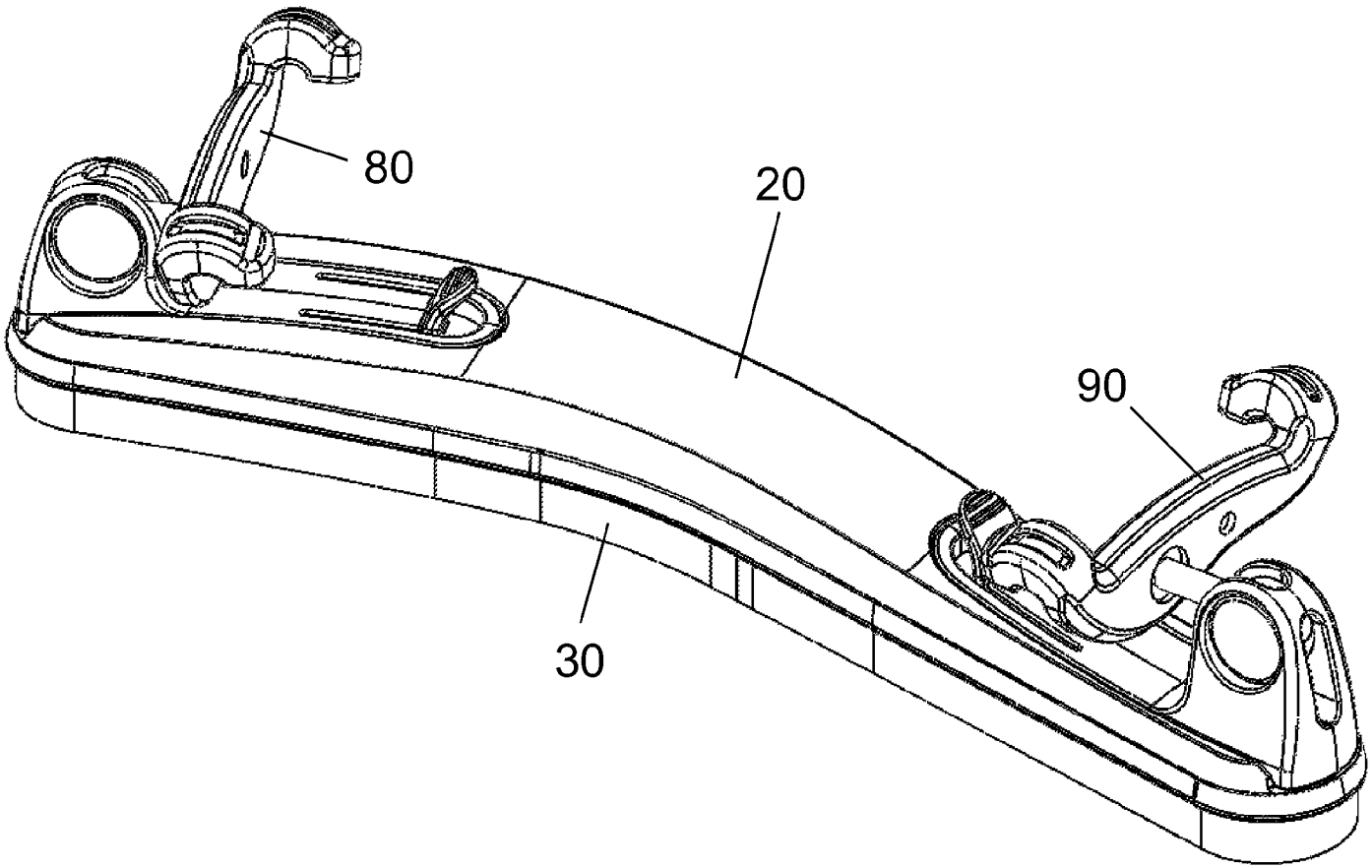
FIG. 17 is another isometric view of the shoulder rest in the folded position.

As noted above, the shoulder rest is both adjustable and foldable. FIG. 11 depicts the shoulder rest with its forks 80, 90 retracted and unfolded in an engaged (unfolded) posture for mounting or clamping to a violin or viola whereas FIG. 12 depicts the forks 80, 90 extended or cantilevered. The forks are independently adjustable and independently foldable (or "collapsible"). FIGS. 13 and 14 are isometric views of the shoulder rest in the retracted and extended positions. The forks may be folded for storage or transport. FIGS. 15-17 show the forks folded.

In this illustrated embodiment, the fork-shaped clamping members (or "forks") 80, 90 are asymmetric. The forks are also rotatable in this illustrated embodiment. In the illustrated embodiment, the forks are threaded onto threaded stems 86, 96 (shown in FIG. 18) that permit the forks to be raised or lowered and that also permit the forks to be rotated relative to the base. The forks can also be folded or unfolded (i.e. closed or opened).

To recap, the shoulder rest 10 further includes a first slidable end member for receiving a threaded stem that supports the first clamping member, the first slidable end member being slidable between a retracted position and an extended position, the first slidable end member also having an arcuate channel or slot through which the stem rotates as the clamping member is pivoted between the unfolded and folded positions. The first slidable end member is slidable within a first slot in the instrument-facing side of the bridge to extend or retract the first clamping member relative to the bridge. Likewise, the shoulder rest 10 further includes a second slidable end member for supporting the second clamping member, the second slidable end member being slidable between a retracted position and an extended position, the second slidable end member also having an arcuate channel through which the stem rotates as the clamping member is pivoted between the unfolded and folded positions, wherein the second slidable end member is slidable within a second slot in the instrument-facing side of the bridge to extend or retract the second clamping member relative to the bridge.

In the illustrated embodiment, there is no locking mechanism to lock the forks in the folded or unfolded postures. However, in other embodiments, there may be a locking mechanism to lock the forks in the folded or unfolded postures. Alternatively, there may be an indexing or friction fit for the fork-folding mechanism.

The shoulder rest is thus adjustable by extending or retracting the forks. The forks are also rotatable as noted above to provide further adjustability. When extended, the slidable end members and their respective forks are cantilevered. When fully extended (cantilevered) there is some lateral and/or torsional play or tolerance to provide a further degree of adjustability. In other words, when extended (cantilevered), the slidable end members may twist to fit the instrument and/or may twist when torque is applied to the attached shoulder rest.

The first slidable end member comprises a first protrusion shaped to engage one of a first plurality of apertures disposed in the first slot. Similarly, the second slidable end member comprises a second protrusion shaped to engage one of a second plurality of apertures disposed in the second slot.

In the illustrated embodiment, the first plurality of apertures comprises transverse grooves disposed substantially orthogonally to an axis of sliding motion of the first support member within the first slot and wherein the second plurality of apertures comprises transverse grooves disposed substantially orthogonally to an axis of sliding motion of the second support member within the second slot and wherein the protrusion is a transverse rib shaped to engage one of the transverse grooves. The transverse grooves are disposed only in an inward half of each slot in the illustrated embodiment.

In the illustrated embodiment, each of the first and second slidable end members comprises a pull-tab unlocking member that flexes when pulled away from the slot to disengage the protrusion from the aperture, the pull-tab unlocking member being elastically biased to return to an unflexed posture against the slot. In the illustrated embodiment, the pull-tab unlocking member comprises an elongated tab terminating in a curved rounded tip that curves away from the slot. The tab has a tab thickness less than a slidable end member thickness and the tab has a tab width less than a slidable end member width.

Figure 18:
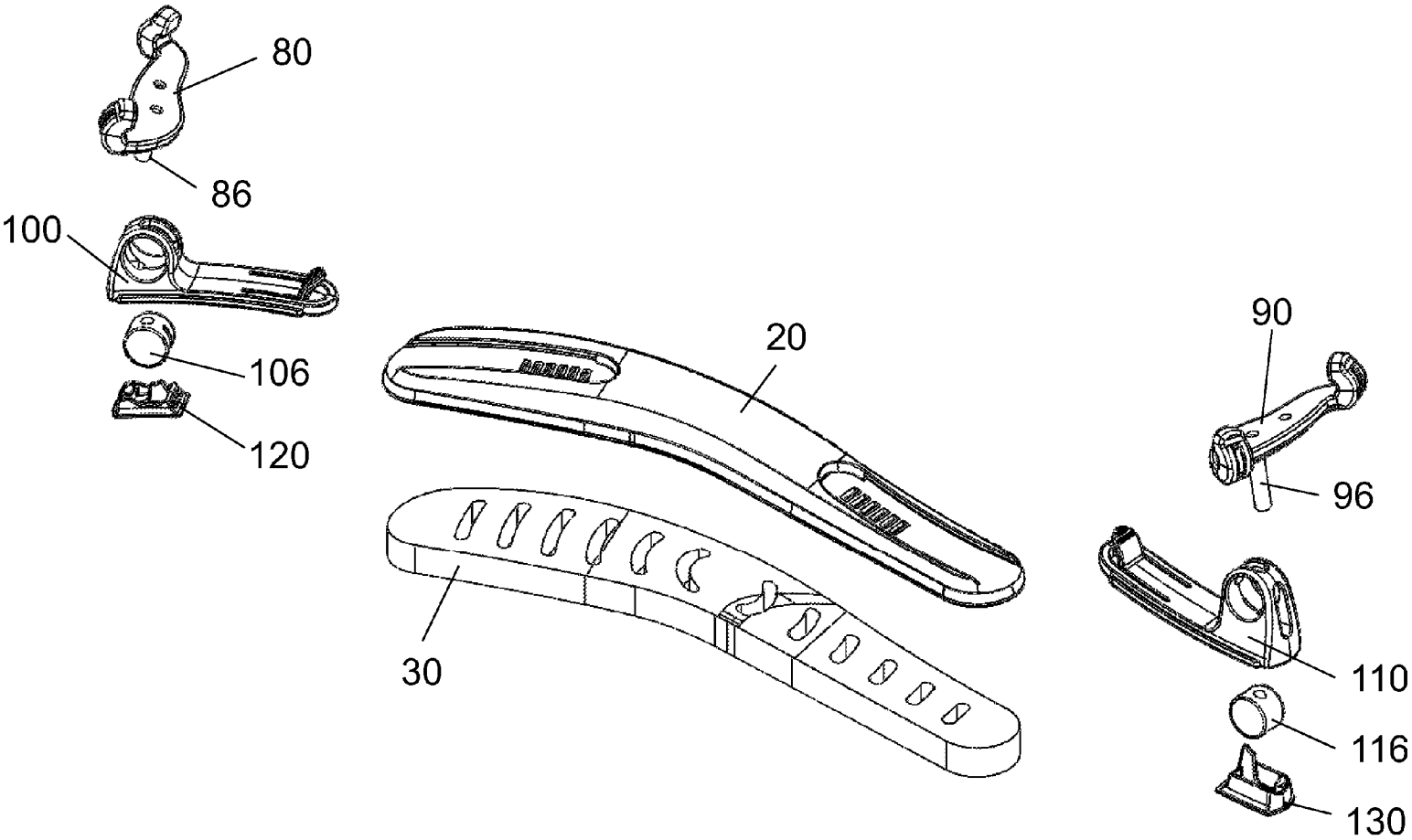
FIG. 18 is an exploded (assembly) view of the shoulder rest.
Figure 19:
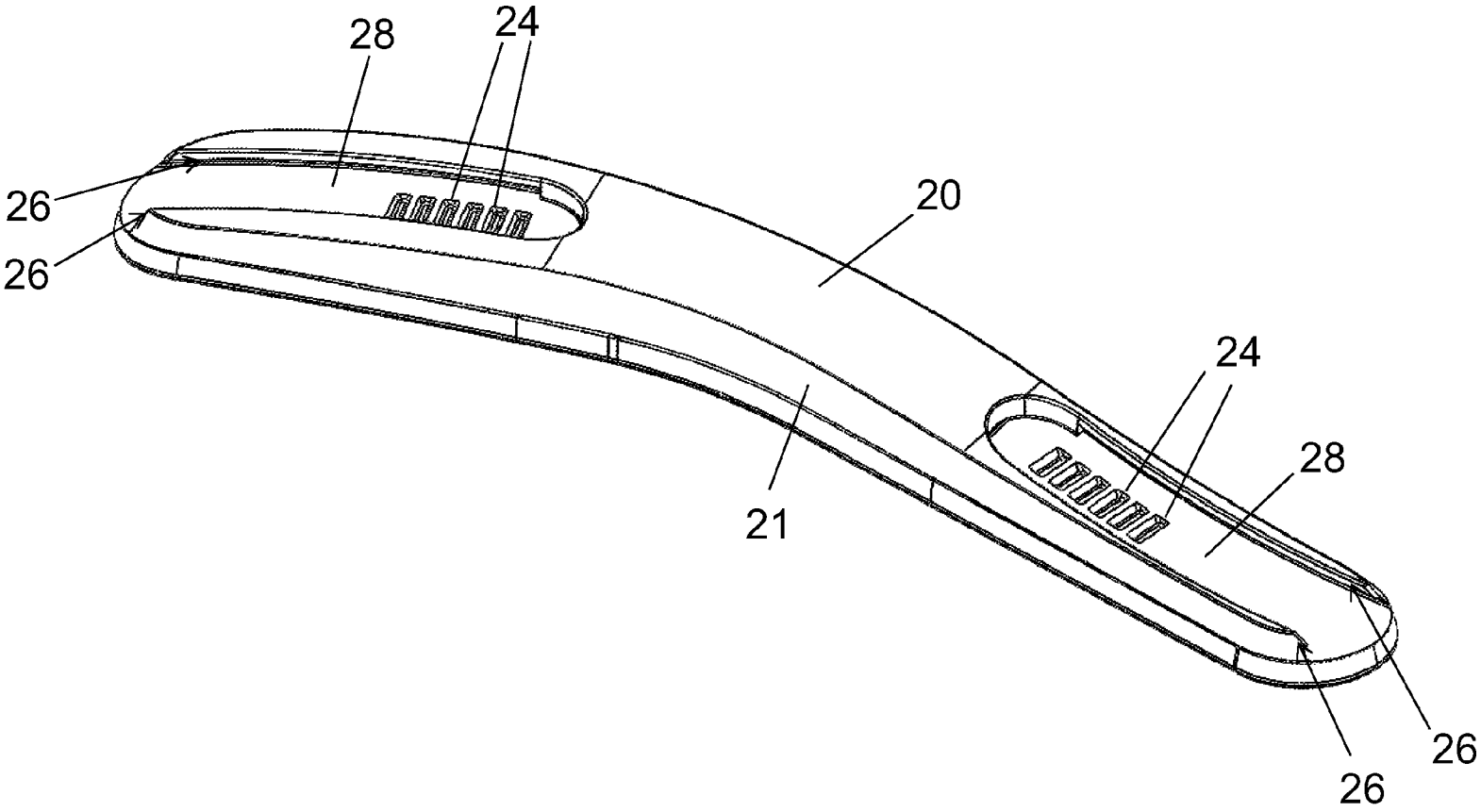
FIG. 19 is an isometric view of the base member.

FIG. 18 is an exploded or assembly view of the main components of the shoulder rest 10, namely the body (bridge) 20, cushion 30, forks 80, 90, slidable end members 100, 110, drums 106, 116 and retainer cover plates 120, 130. FIG. 19 is an isometric view of the body (bridge) 20. To assemble the shoulder rest, the pad 30 is attached to the body 20. The stems of the forks are fastened to the drums 106, 116 which are rotationally housed within the bores of the end members 100, 110. The retainer cover plates 120, 130 are snapped into place to hold the drums inside the bores of the slidable end members.

The body (or bridge) 20 may have a chamfer 21 along the sides of the body as illustrated in FIG. 19. The chamfered body makes it easier to hold and manipulate the body and also embellishes the appearance of the body. The body 20 has first and second slots 28 having a plurality of apertures, e.g. transverse grooves 24. These may be disposed on a forward (innermost) half of the slot. A pair of guide lips or grooves 26 extend along the sides of the slot to retain the tongue-shaped slider.

Figure 20:
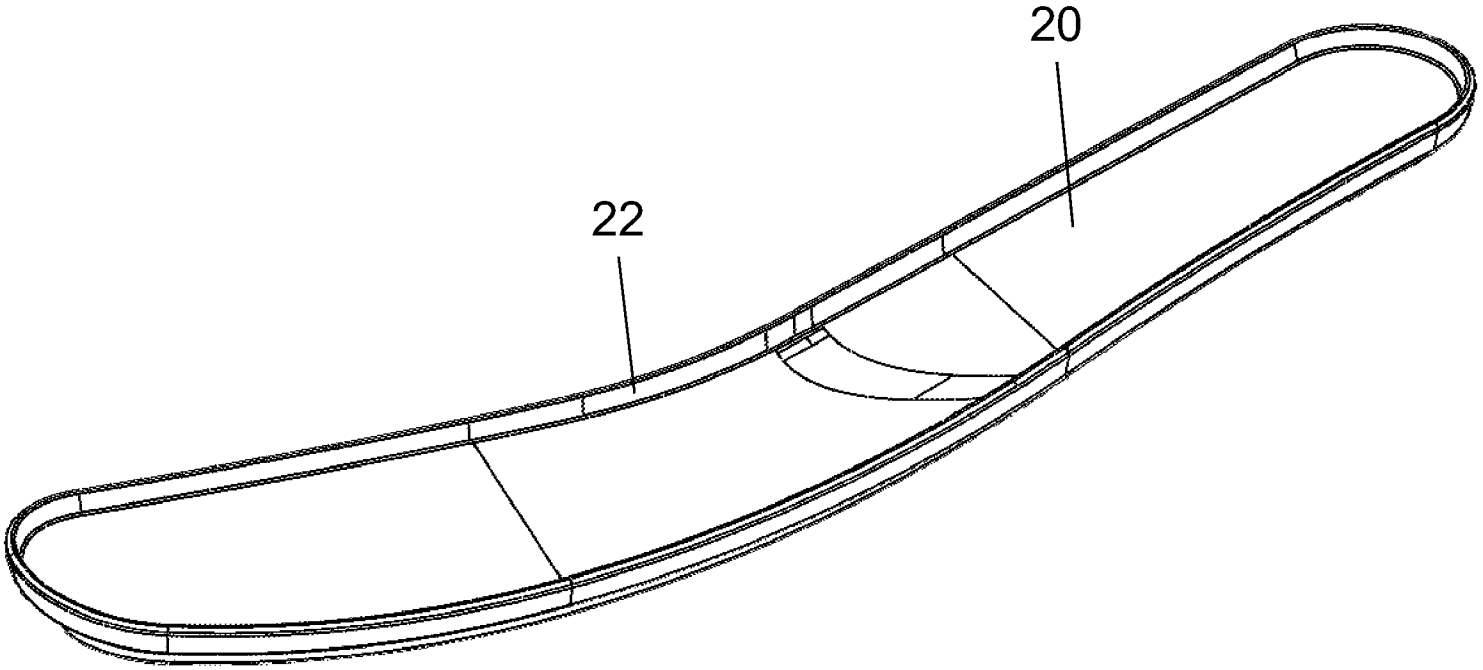
FIG. 20 is another isometric view of the underside of the base member.

FIG. 20 is an underside isometric view of the body 20 of the shoulder rest. The underside may have a lip or rim 22 extending around the perimeter of the body into which the cushion may be partially recessed.

Figure 21:
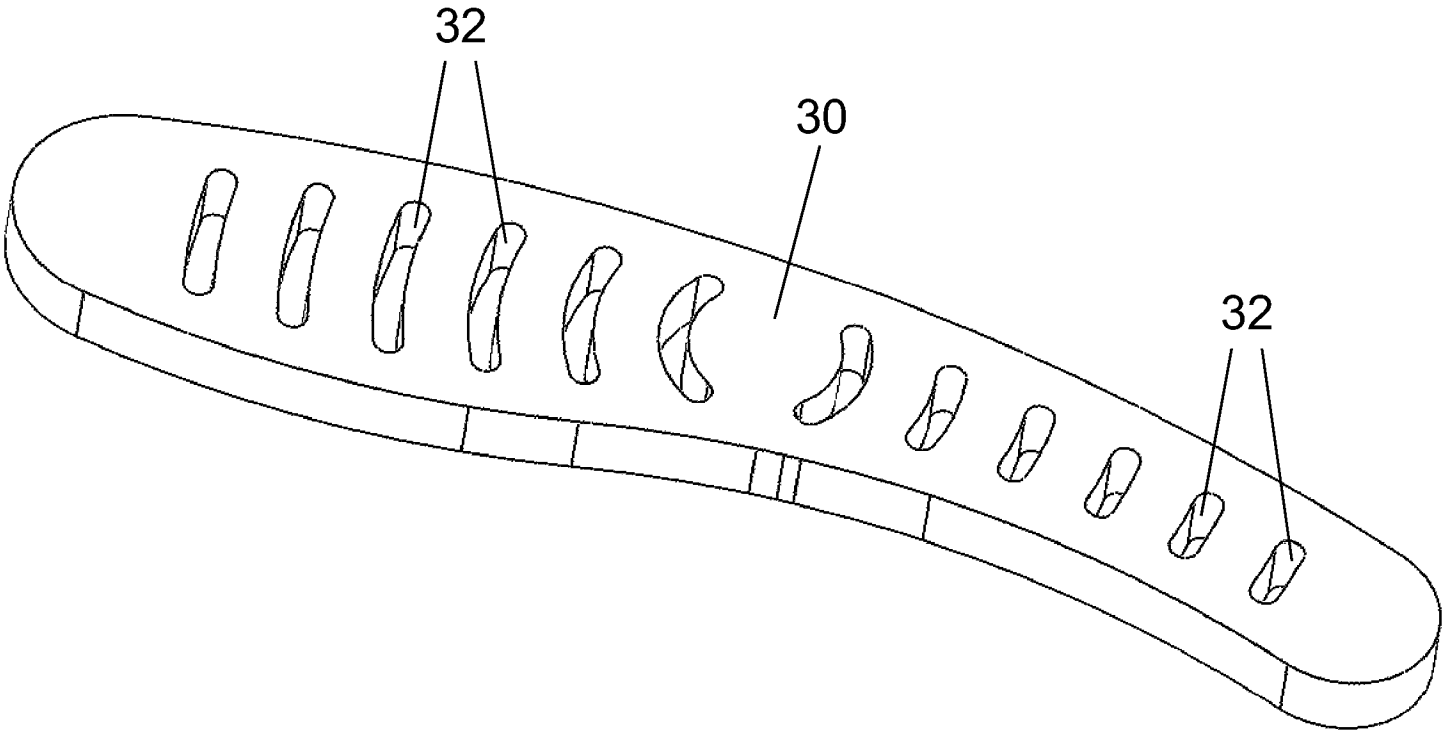
FIG. 21 is an isometric view of the foam cushion or pad with its die-cut holes.

FIG. 21 is an isometric view of the foam cushion 30 or foam pad. As shown the cushion has a plurality of openings, holes or apertures 32. The foam cushion or pad as illustrated in FIG. 21 has a contour or shape that matches the body. As further illustrated, the cushion or pad has a uniform thickness although this is not necessarily so in other embodiments. The cushion is a single integral piece of foam in FIG. 21 although in other embodiments it may be constituted of two or more pieces.

FIGS. 22-40 depict structural details of the slidable shoulder end member and the slidable clavicle end member.

Figure 22:
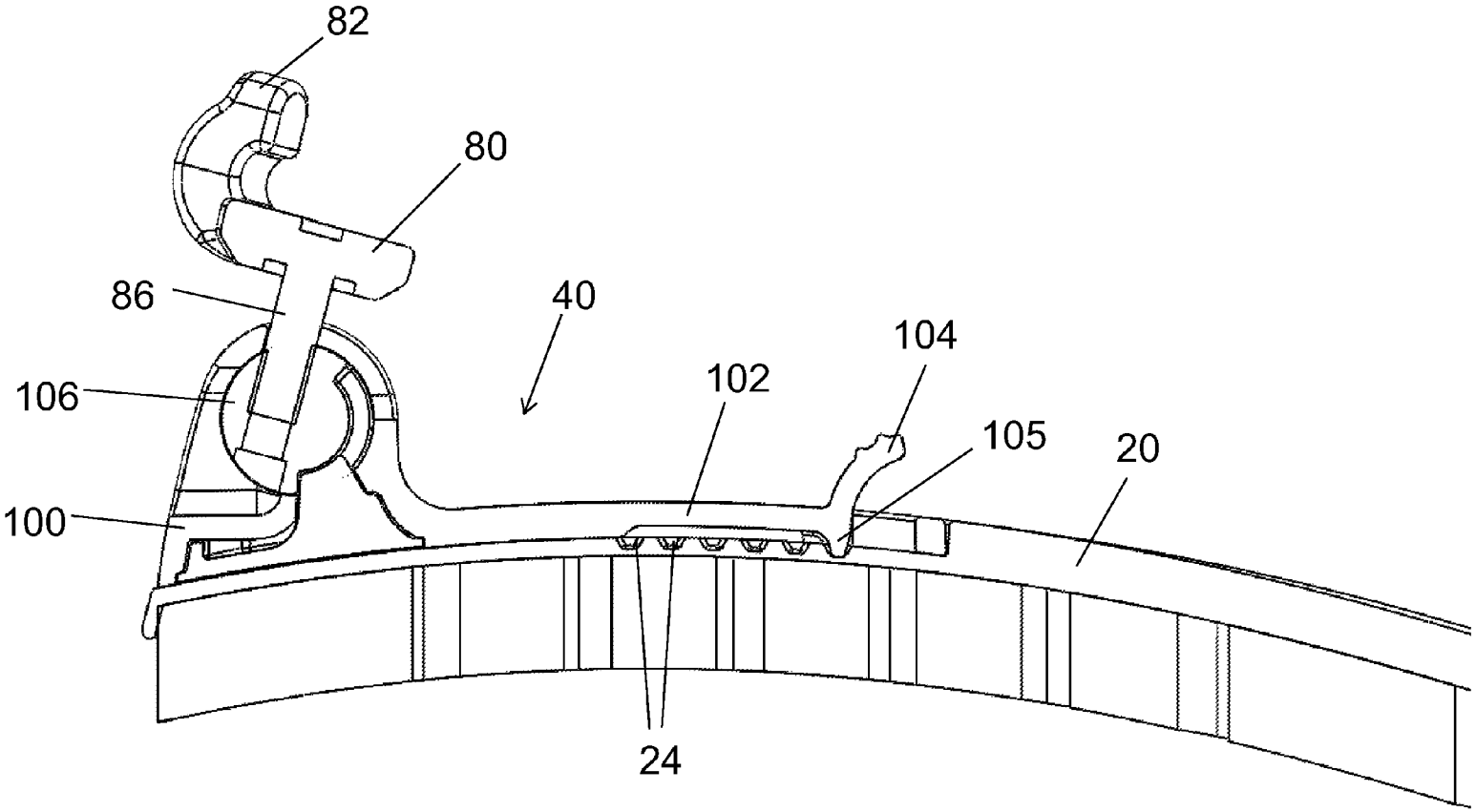
FIG. 22 is a side cross-sectional view of the shoulder end.
Figure 23:
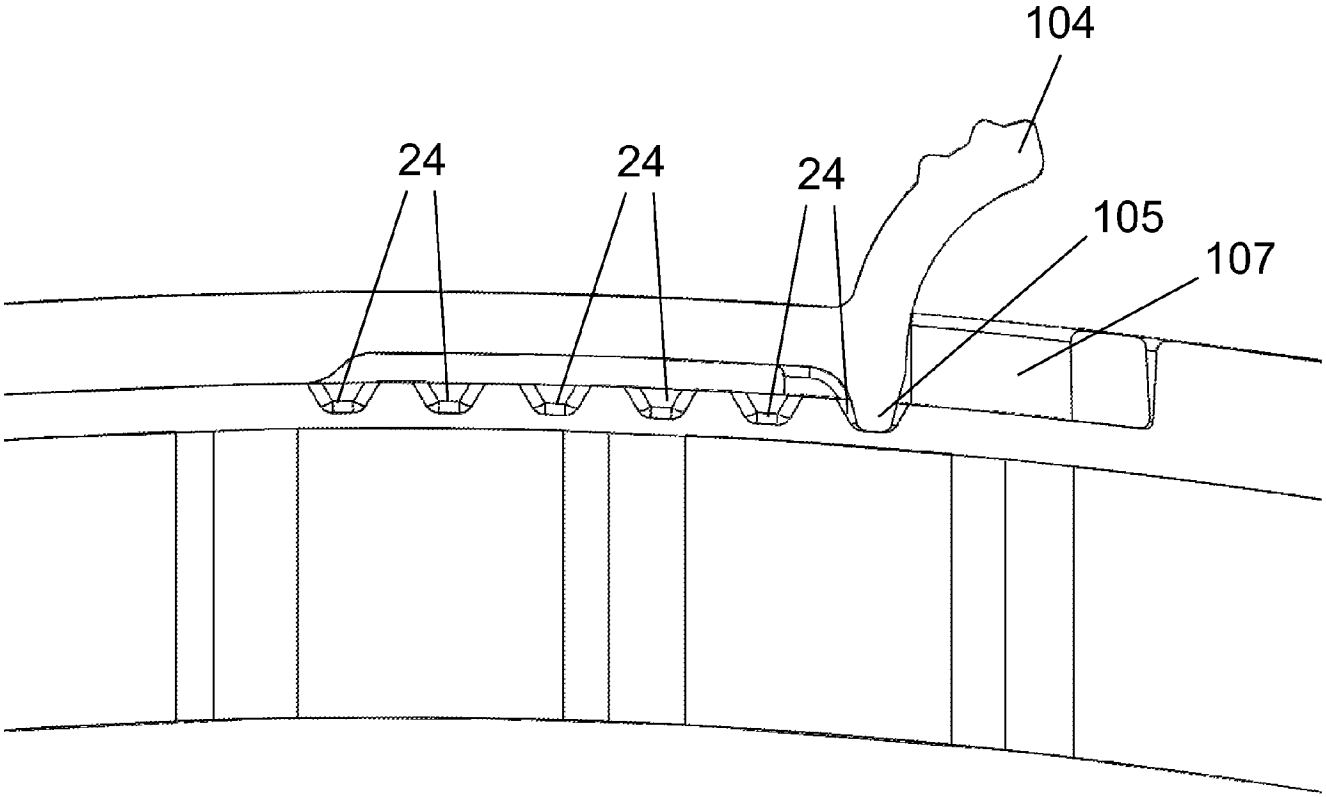
FIG. 23 is a side cross-sectional view of the pull-tab adjustment mechanism for extending or retracting the slidable shoulder end member and its fork.

FIG. 22 shows the shoulder end 40. This figure shows that the fork 80 is mounted onto its threaded stem 86. This enables the fork 80 to be raised or lowered relative to the base 20 and also enables the fork to be rotated relative to the base. The stem threads into a correspondingly threaded collar or bore within the rotatable drum. As illustrated, the first slidable end member (shoulder end member) 100 comprises a cylindrical drum-like component. FIG. 23 shows the pull-tab adjustment mechanism for the slidable shoulder end member. Note that the sliding path is convex at the shoulder end 40 as shown in FIG. 22. FIGS. 22 and 23 show that the transverse grooves 24 may be tapered or flared to receive a similarly shaped protrusion 105 or tooth. Six grooves 24 are depicted although this number may be varied in other embodiments. Accordingly, the protrusion may be seated in any one of six positions to provide six different degrees of linear extension. FIG. 23 shows how the pull tab 104 may be arcuate or curved although other shapes or profiles may be employed. This figure also shows how there is a forward space 107 to provide sufficient finger or thumb clearance to lift the pull tab 104.

Figure 24:
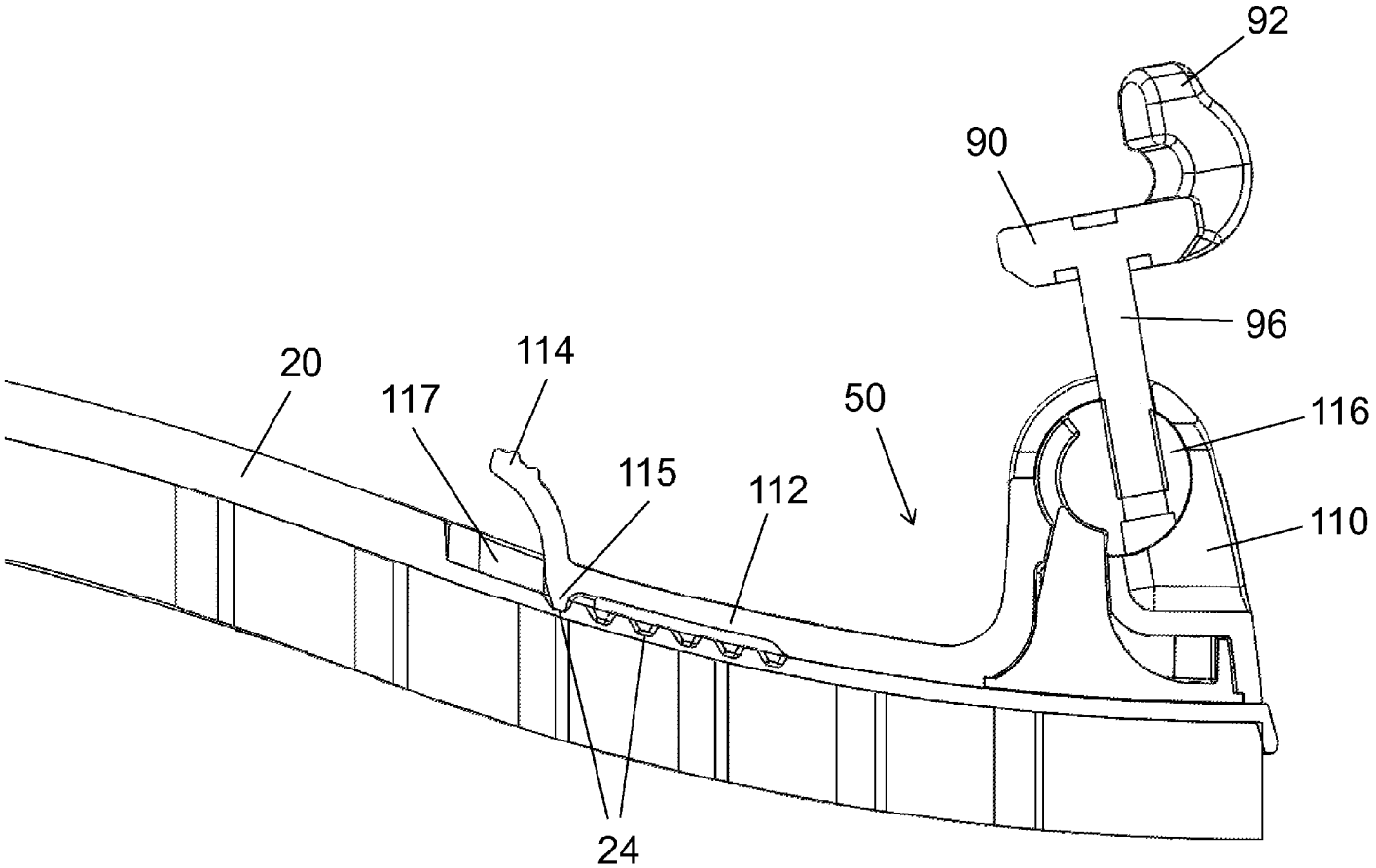
FIG. 24 is a side cross-sectional view of the clavicle end.
Figure 25:
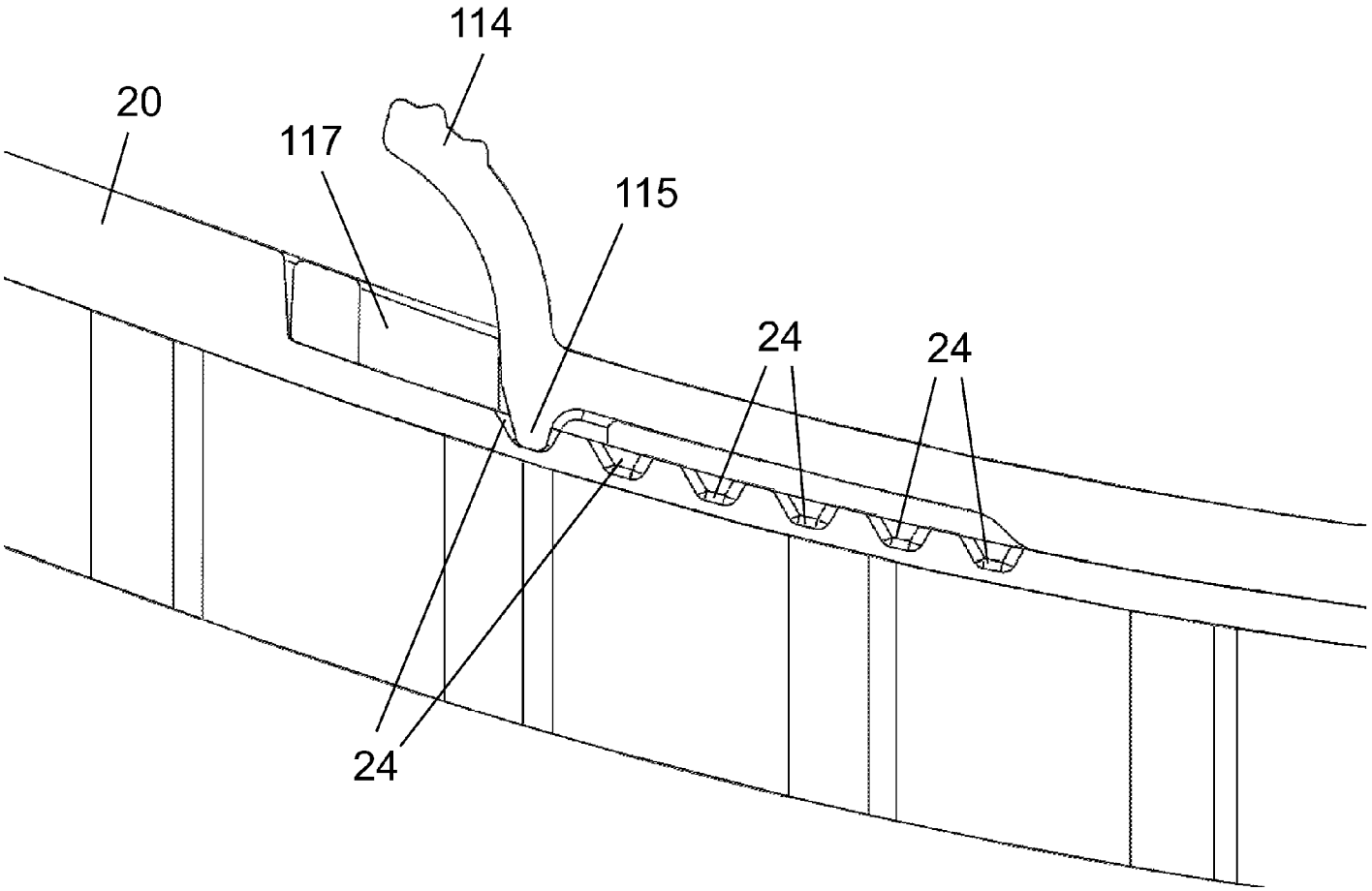
FIG. 25 is a side cross-sectional view of the pull-tab adjustment mechanism for extending or retracting the slidable clavicle end member and its fork.

FIG. 24 shows the clavicle end 50, which provides a concave sliding path for the tongue-shaped slider 112. FIG. 25 shows the pull-tab adjustment mechanism for the slidable clavicle end member 110. The pull tab 114 is lifted or pulled to displace the protrusion from one groove 24 to another. A front space 117 is provided for finger or thumb access to the pull tab 114. Sliding the clavicle end member 110 shown in FIG. 24 causes the fork 90 and its fingers or tines 92 to move. The fork 90 is supported by threaded stem 96 and is rotatable with the drum as will be explained in greater detail below.

Figure 26:
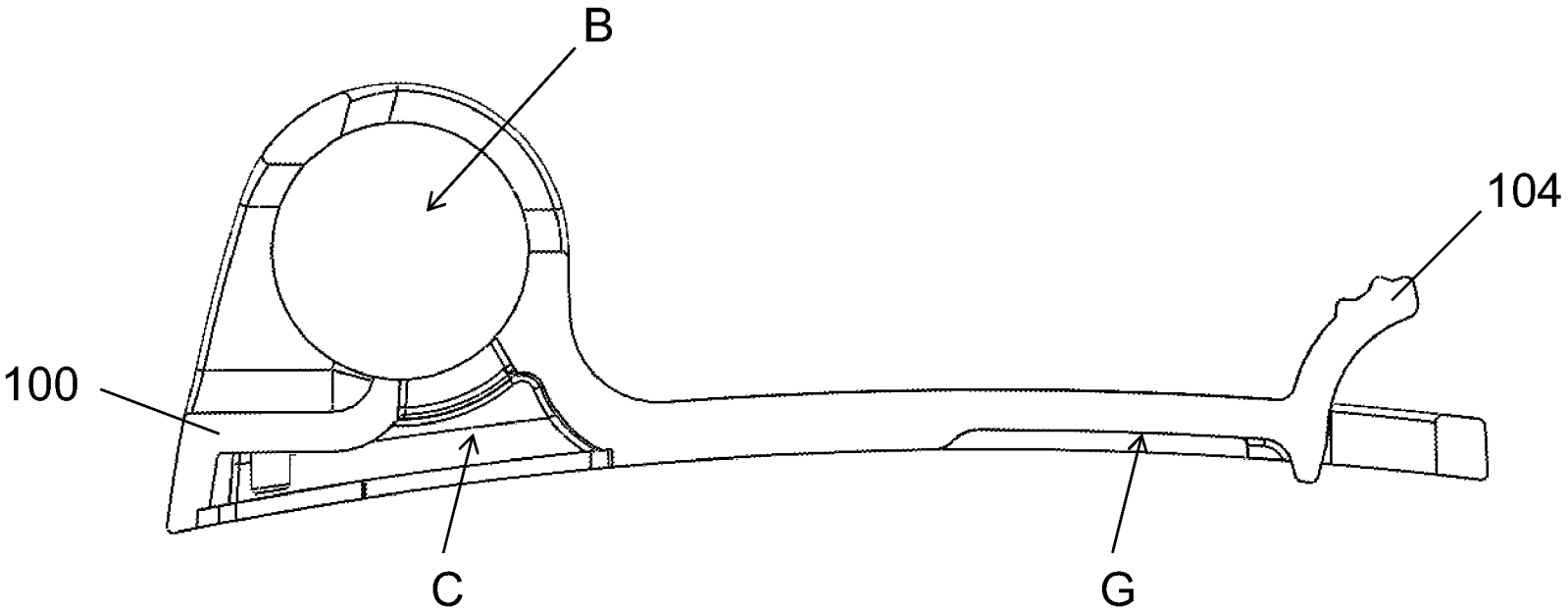
FIG. 26 is a side cross-sectional view of the slidable shoulder end member.
Figure 27:
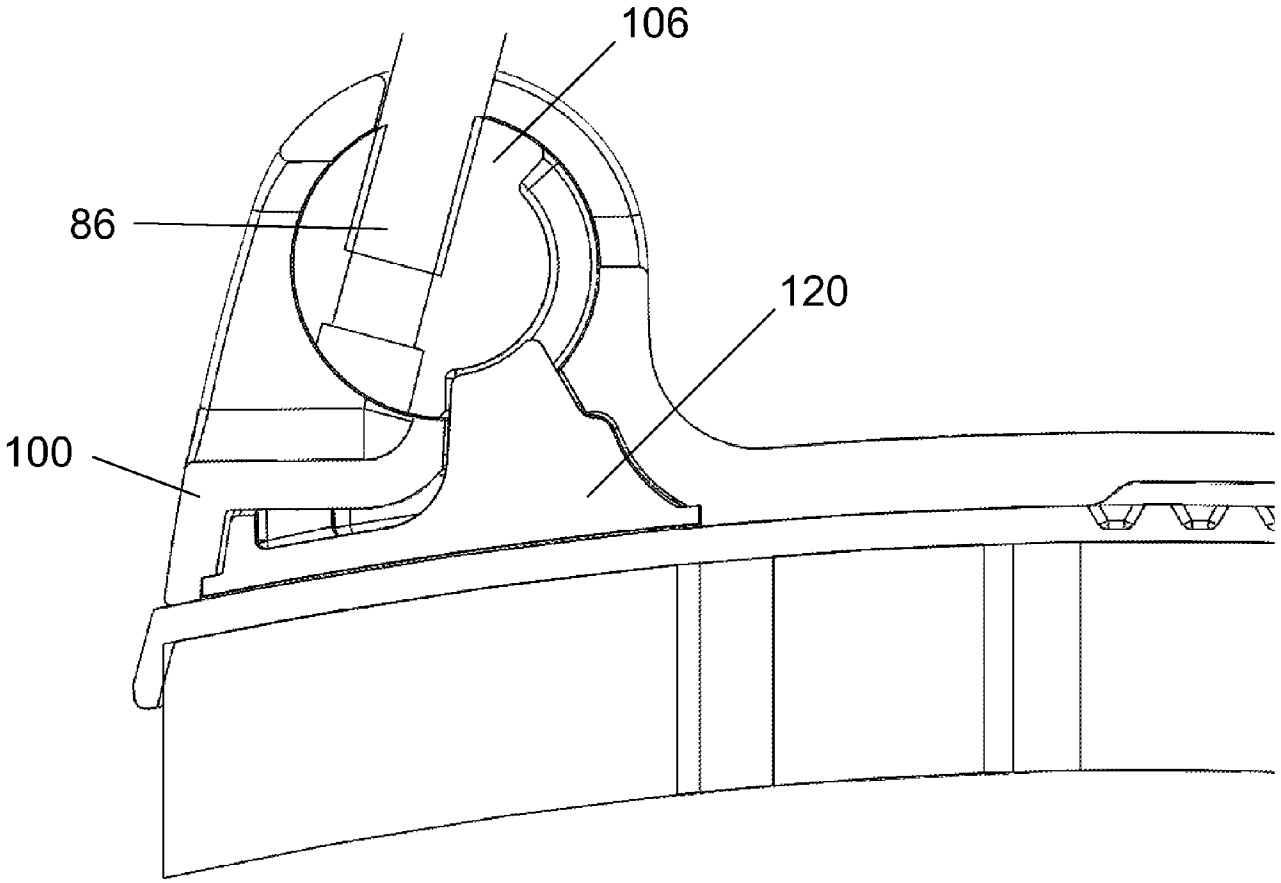
FIG. 27 is an enlarged side cross-sectional view of the slidable shoulder end member showing a stem mounted to a rotatable encapsulated drum.

FIG. 26 shows the slidable shoulder end member 100 which includes a bore B for receiving and encapsulating a drum. A gap G is provided by a narrowing or thinning of the tongue-shaped slider in the zone immediately before the protrusion to augment local flexure. A cavity C is provided below the bore B for receiving the retainer cover plate. FIG. 27 is an enlarged side view of the slidable shoulder end member 100 showing a stem 86 fastened to the rotatable encapsulated drum 106. A retainer cover plate 120 is snapped into place in the cavity in the bottom of the end member 100 to hold the drum 106 in place.

Figure 28:
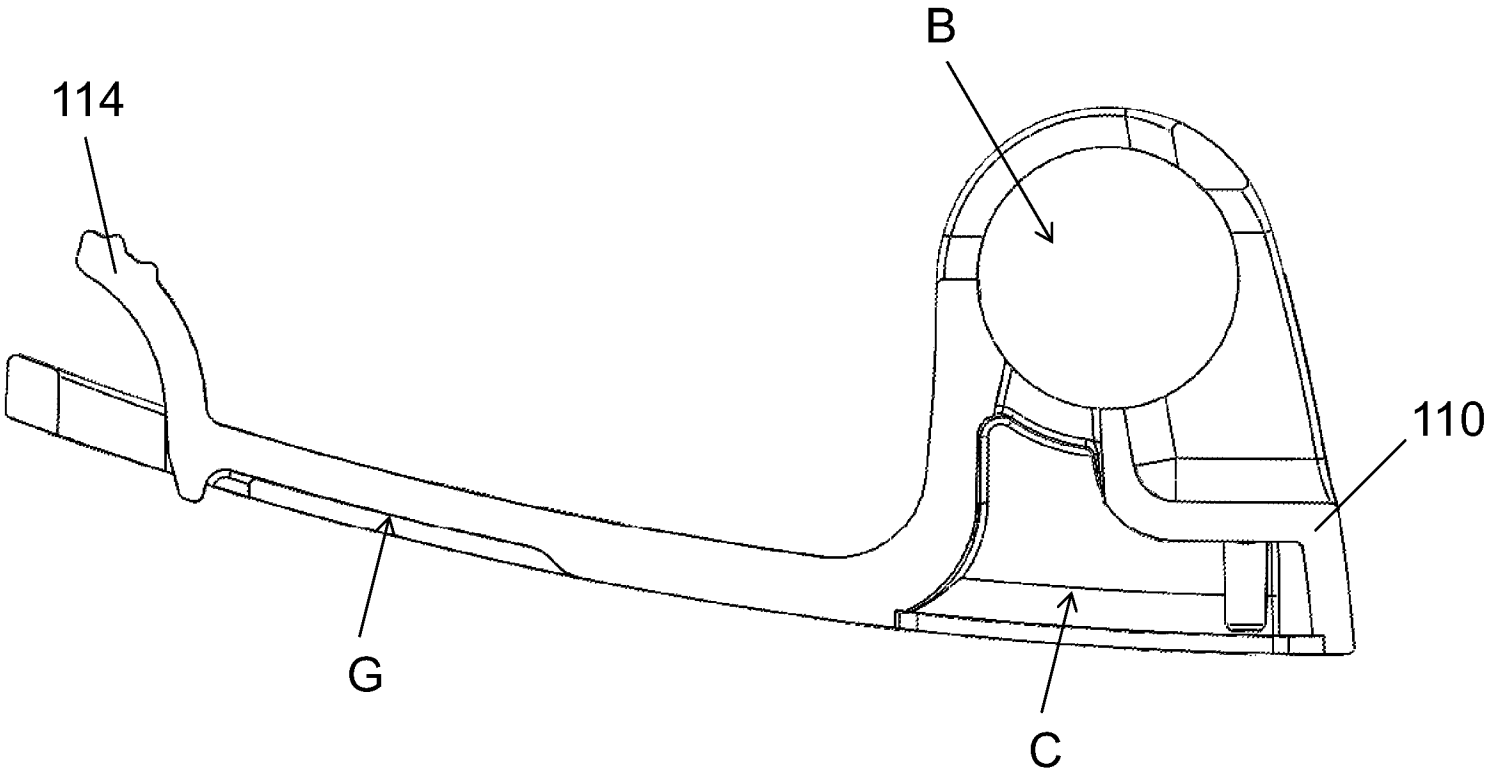
FIG. 28 is a side cross-sectional view of the slidable clavicle end member.
Figure 29:
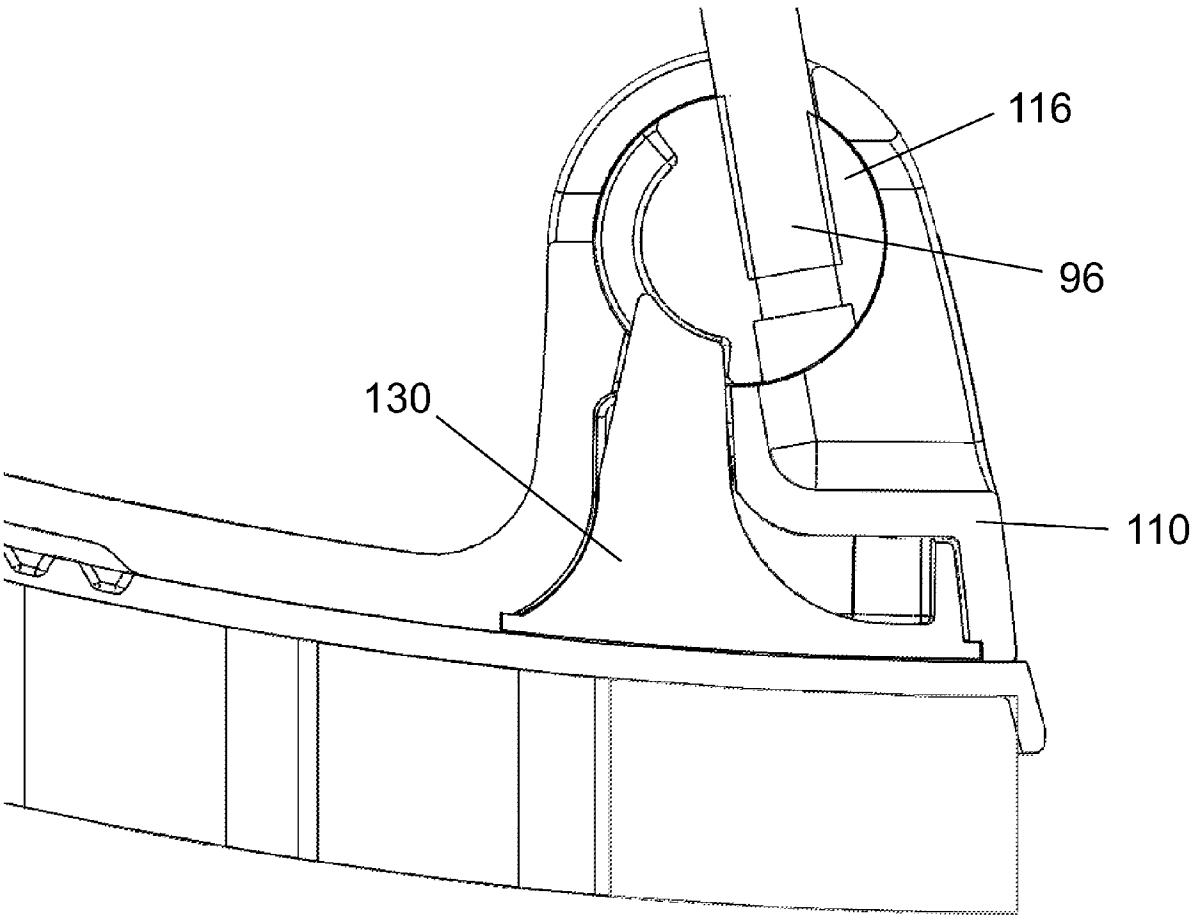
FIG. 29 is an enlarged side cross-sectional view of the slidable clavicle end member showing a stem mounted to a rotatable encapsulated drum.

FIG. 28 is a side view of the slidable clavicle end member 110 having analogous bore B, cavity C and gap G as described above. FIG. 29 is an enlarged side view of the slidable clavicle end member 110 showing a stem 96 fastened to a rotatable encapsulated drum 116. A retainer cover plate 130 is snapped into place into the cavity C to retain the drum inside the bore B of the slidable clavicle member 110.

Figure 30:
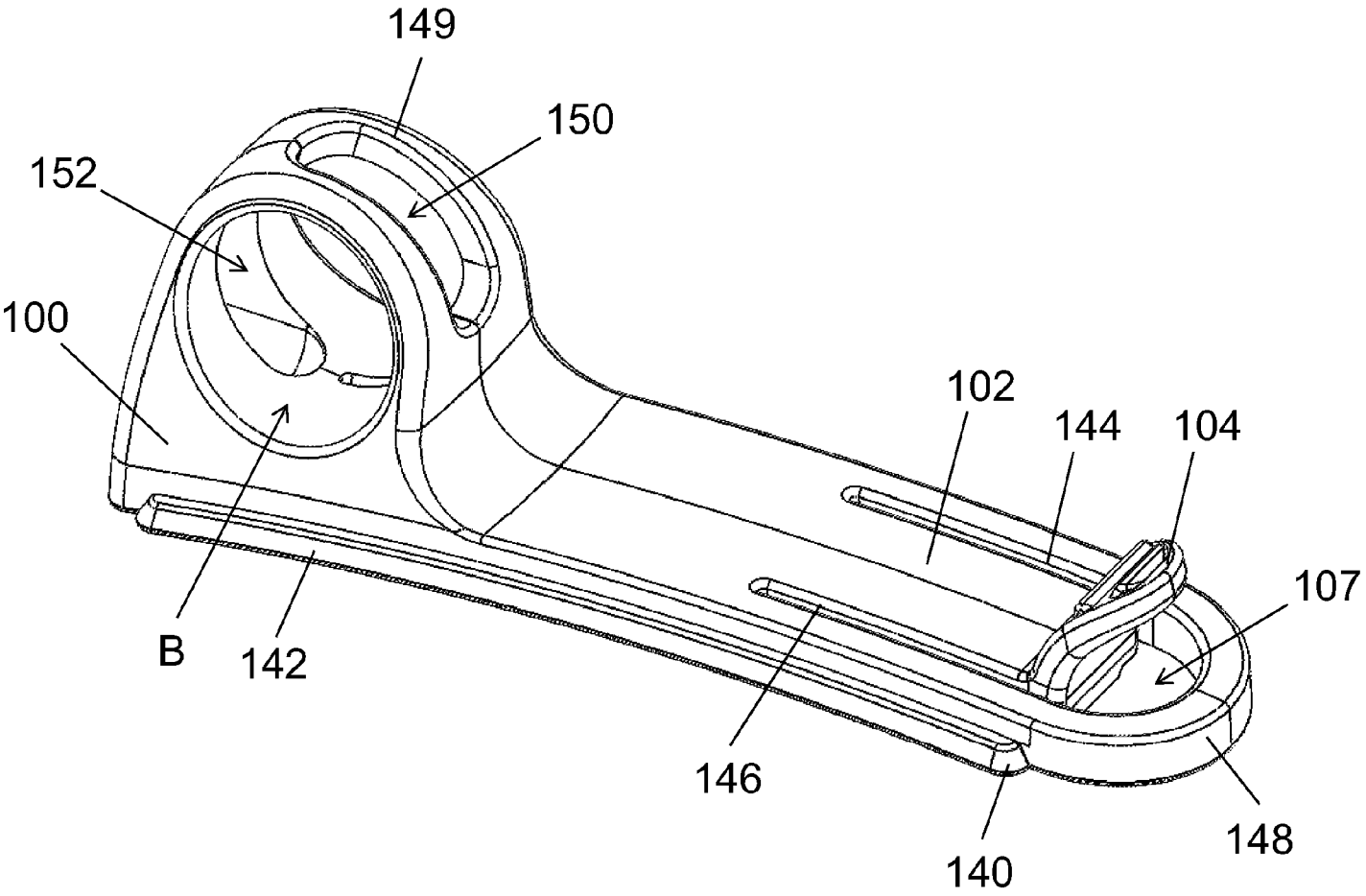
FIG. 30 is an isometric view of the slidable shoulder end member.

FIG. 30 illustrates the slidable shoulder end member 100. The slidable shoulder end member 100 has a pull tab 104 and a rounded or semicircular forward end 148 defining a finger access space 107 for accessing the pull tab 104. The pull tab is integrally formed with a tongue-shaped slider 102 and is partly laterally separated from the slider by two narrow grooves or channels 144, 146. Running along the edges of the end member are lips 142 for sliding within the grooves 26 of the slot 28 in the body 20 as shown in FIG. 19. The rounded front 140 of each lip 142 facilitates insertion into the grooves. As depicted in FIG. 30, the end member 100 has a rotational housing 149 defining a bore B for receiving and encapsulating the drum 106. The rotational housing 149 has a first arcuate slot 150 to permit the stem to rotate when the fork is folded. The housing 149 also has a second arcuate slot 152 to provide clearance for rotation of the bottom portion of the stem when the fork is lowered. In other words, the bottom portion of the stem may extend beyond the drum when the fork is lowered, thereby requiring rear clearance for the bottom extended portion of the stem to rotate with the drum.

Figure 31:
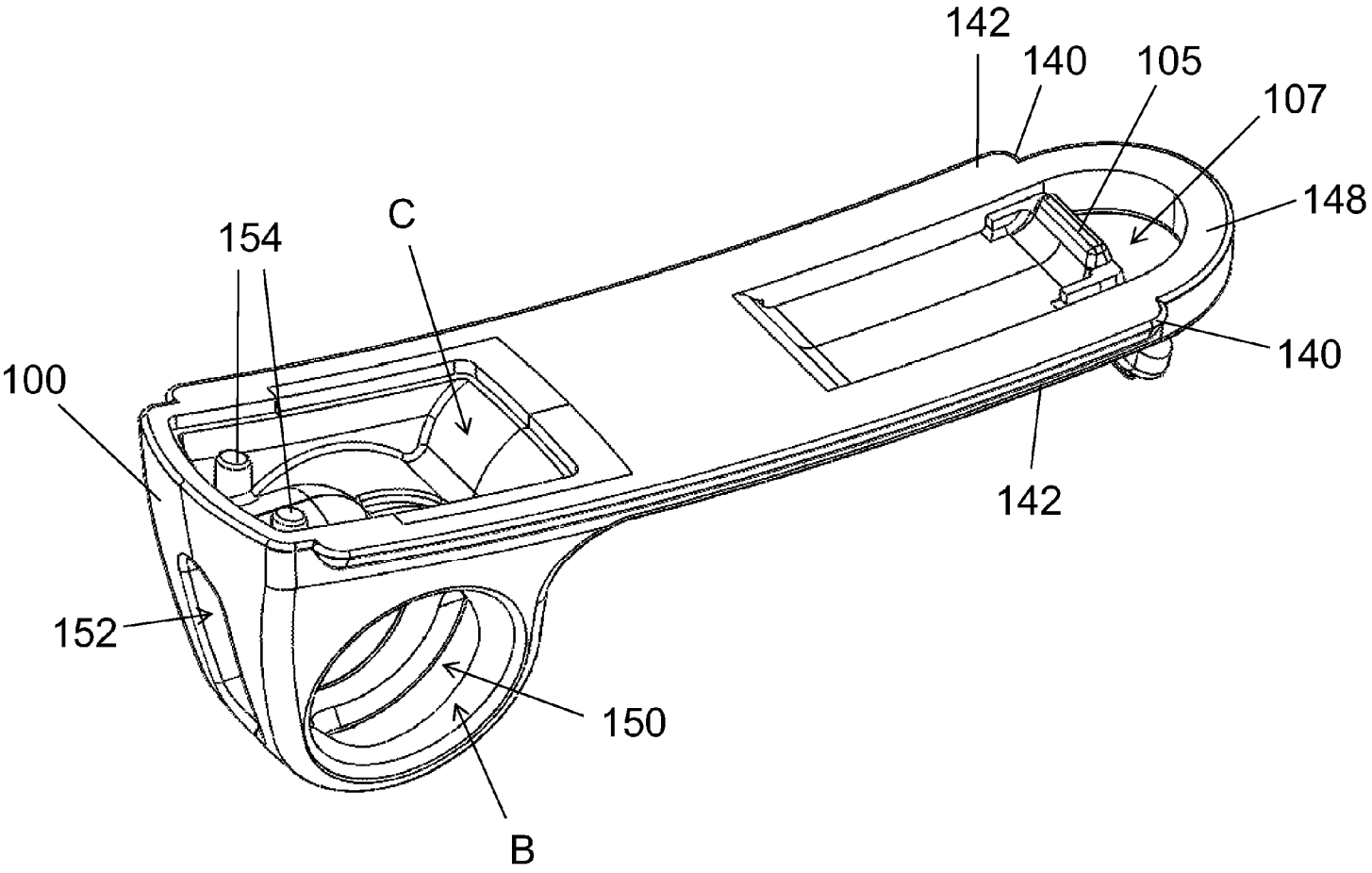
FIG. 31 is an isometric view of the underside of the slidable shoulder end member.

FIG. 31 depicts the underside of the slidable shoulder end member 100.

The underside has a cavity C. Two protuberances 154 are provided for snap connection to sockets 122 shown in FIG. 32. The underside view of FIG. 31 also shows the protrusion 105.

Figure 32:
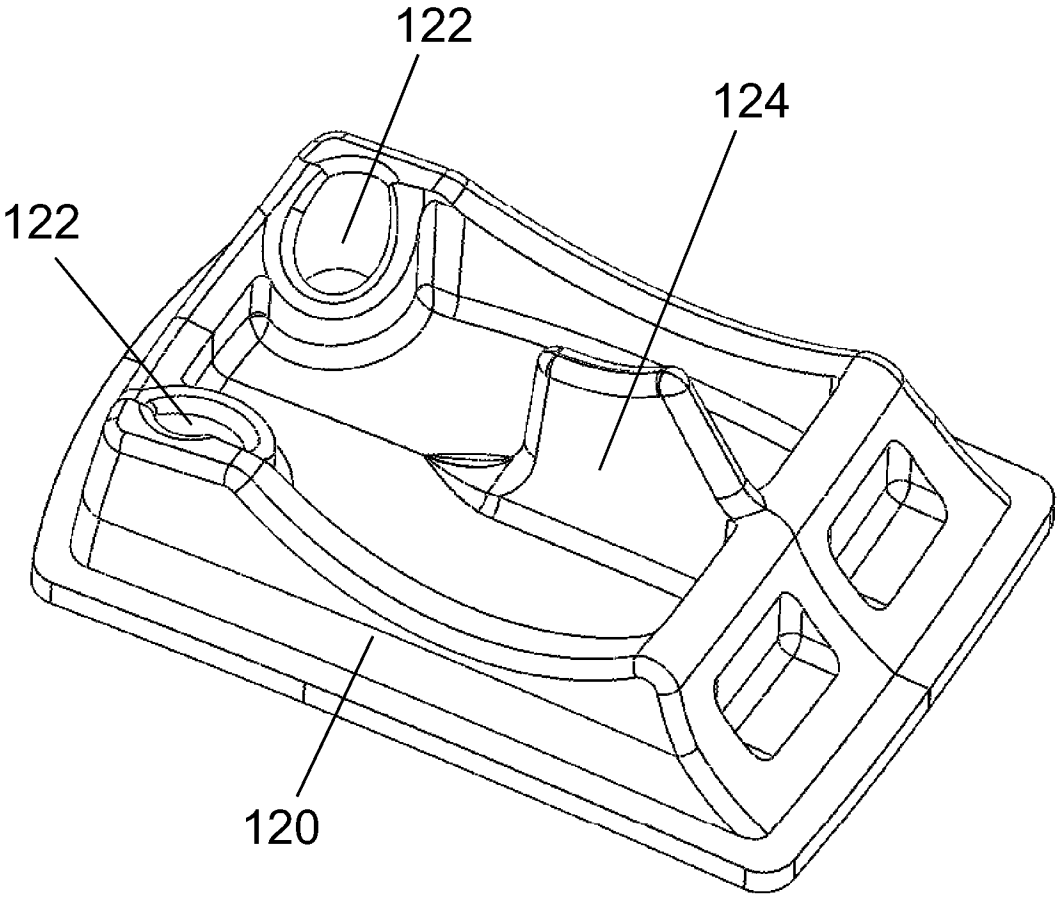
FIG. 32 is an isometric view of the shoulder end member retaining plate showing interior structure.
Figure 33:
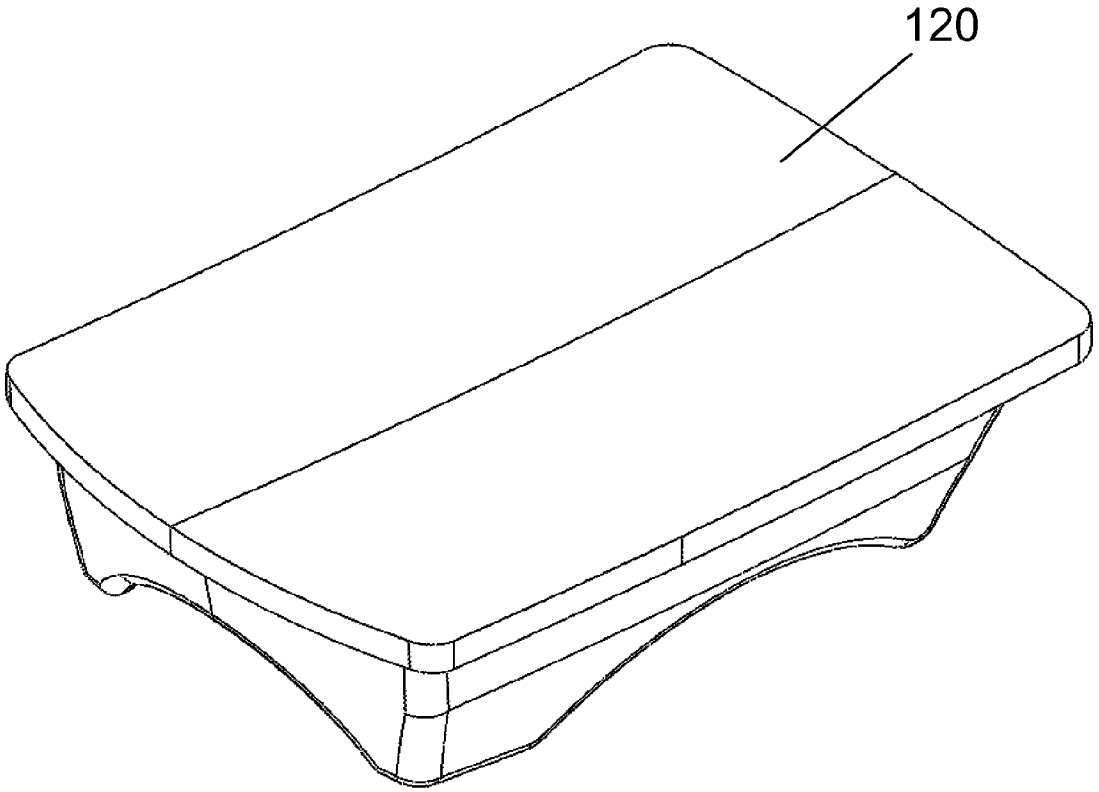
FIG. 33 is an isometric view of the shoulder end member retaining plate showing the exterior face.

FIG. 32 illustrates the shoulder end member retaining plate (retainer cover plate) 120. A retainer guide fin 124 is provided to both retain the drum in place and also to guide the drum as it rotates. FIG. 33 shows the smooth exterior face of the shoulder end member retaining plate.

Figure 34:
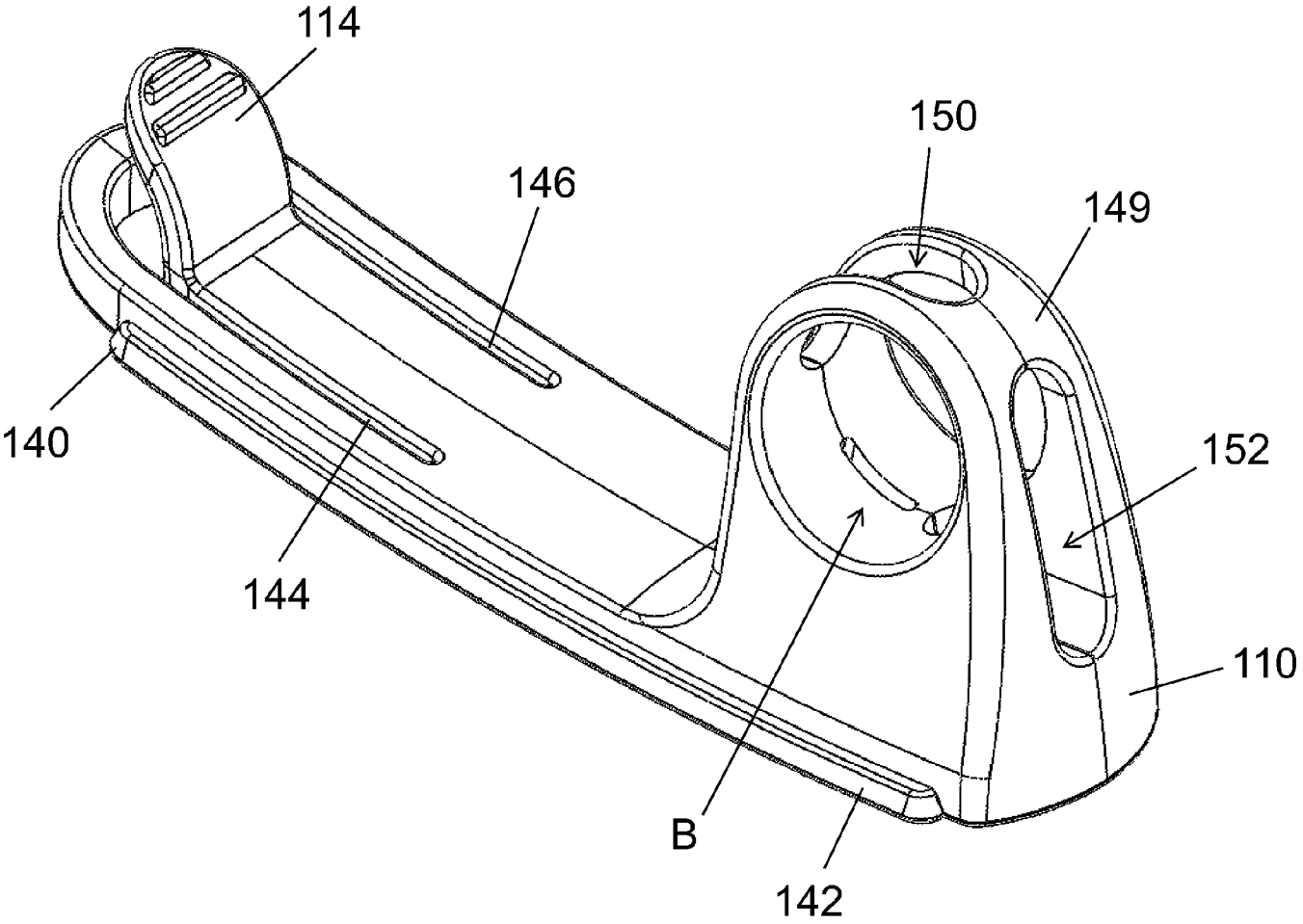
FIG. 34 is an isometric view of the slidable clavicle end member.
Figure 35:
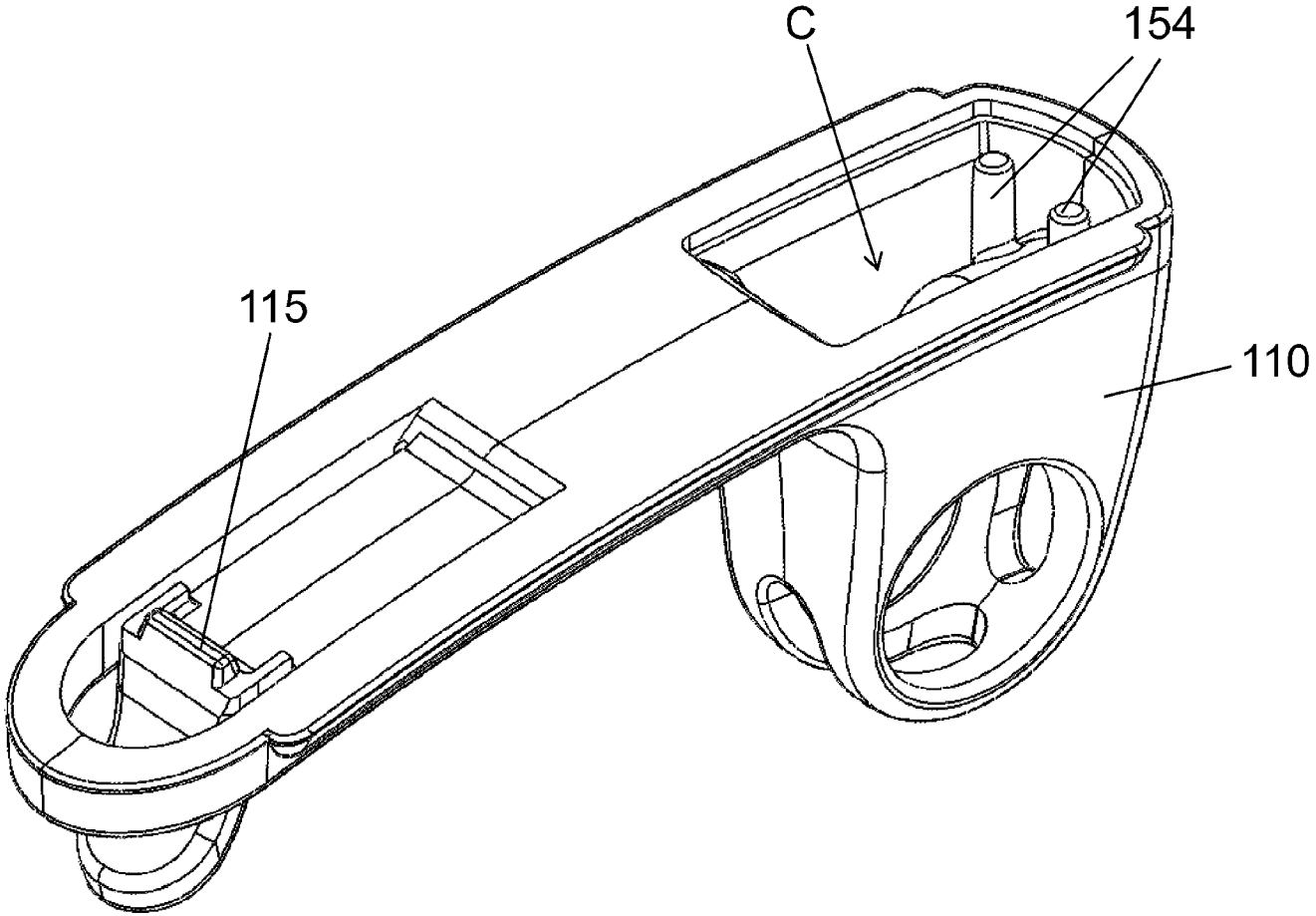
FIG. 35 is an isometric view of the underside of the slidable clavicle end member.
Figure 36:
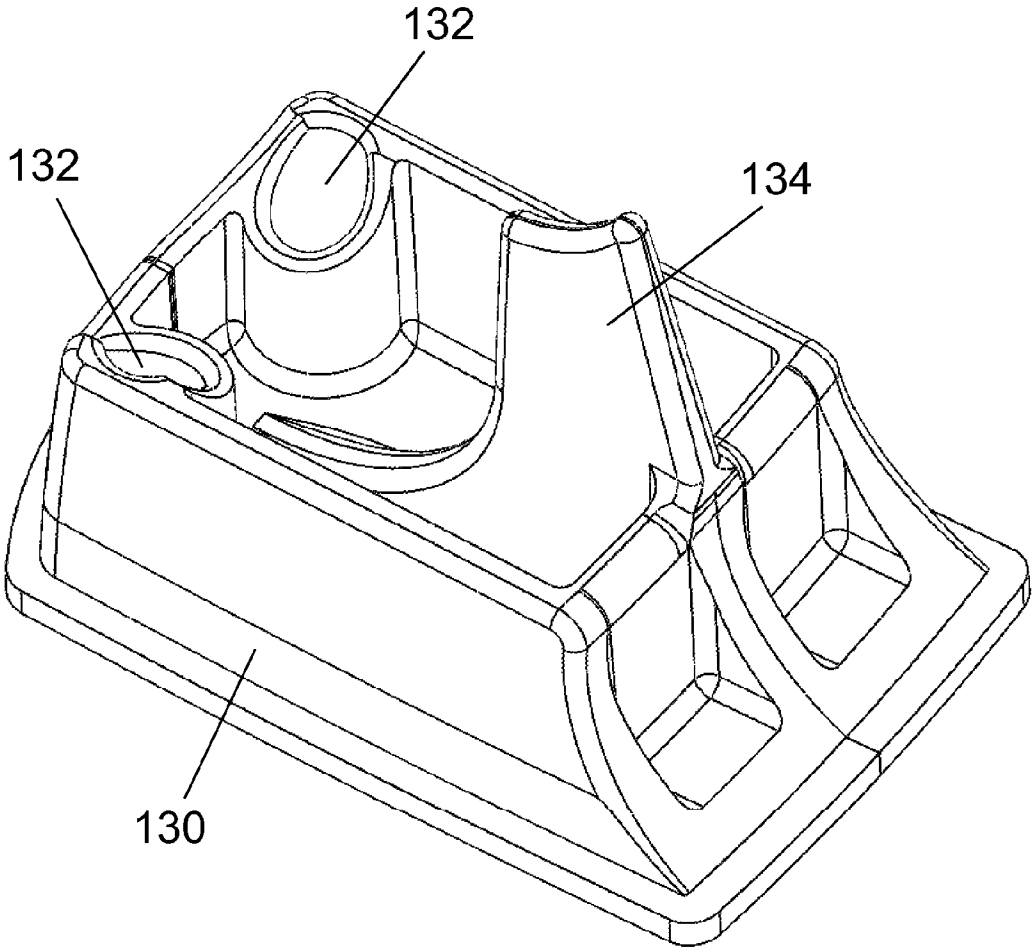
FIG. 36 is an isometric view of the clavicle end member retaining plate showing interior structure.
Figure 37:
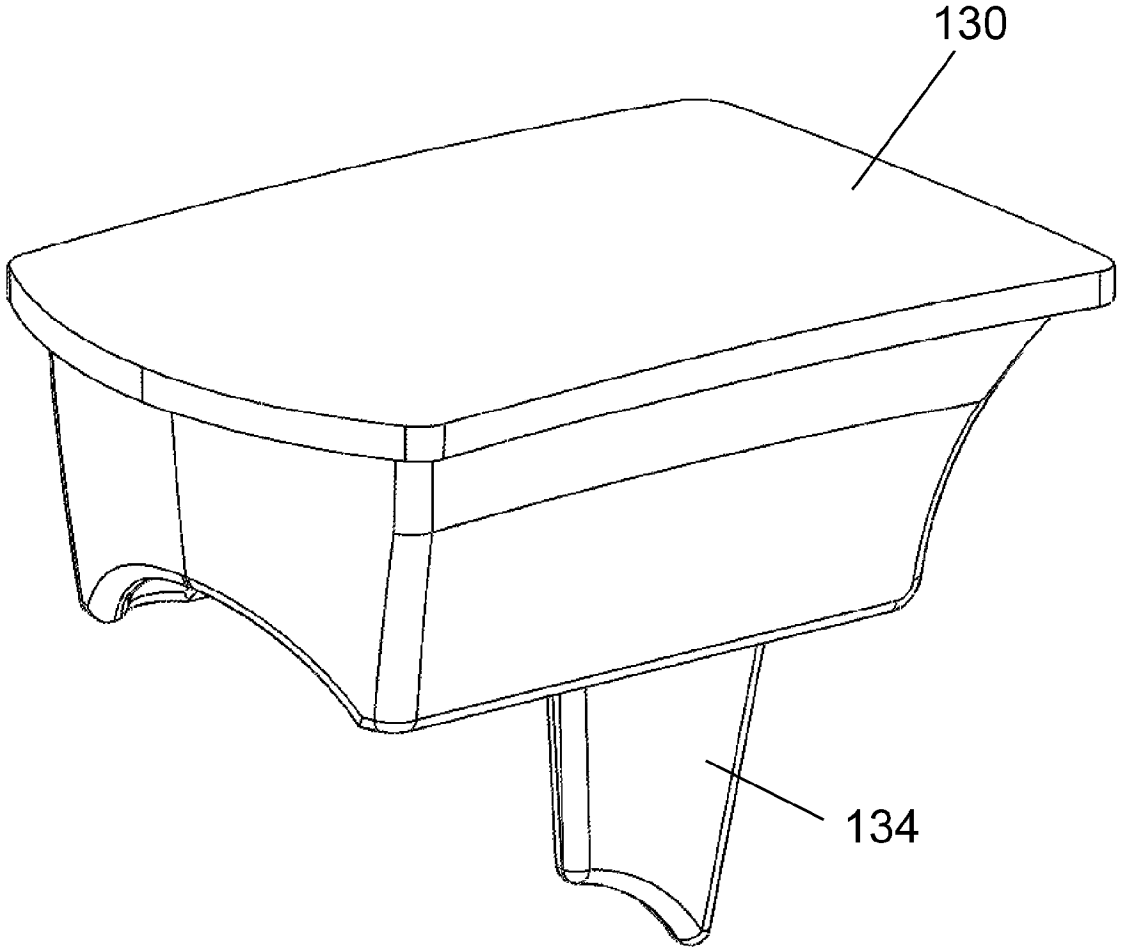
FIG. 37 is an isometric view of the clavicle end member retaining plate showing the exterior face.

The structure of the clavicle end member is similar and analogous to that of the shoulder end member as can be seen from FIG. 34. The clavicle end member 110 has the pull tab 114, channels 144, 146, side edge lips 142 with rounded front 140, rotational housing 149 defining the bore B and first and second arcuate slots 150, 152. In the underside view of FIG. 35, there is a cavity C and protuberances 154 for snap connection to sockets 134 of cover plate 130 shown in FIG. 36. A retainer guide fin 134 retains and guides the drum. The fin 134 is taller than fin 124. The exterior face of the clavicle end member retaining plate is smooth as shown in FIG. 37.

Figure 38:
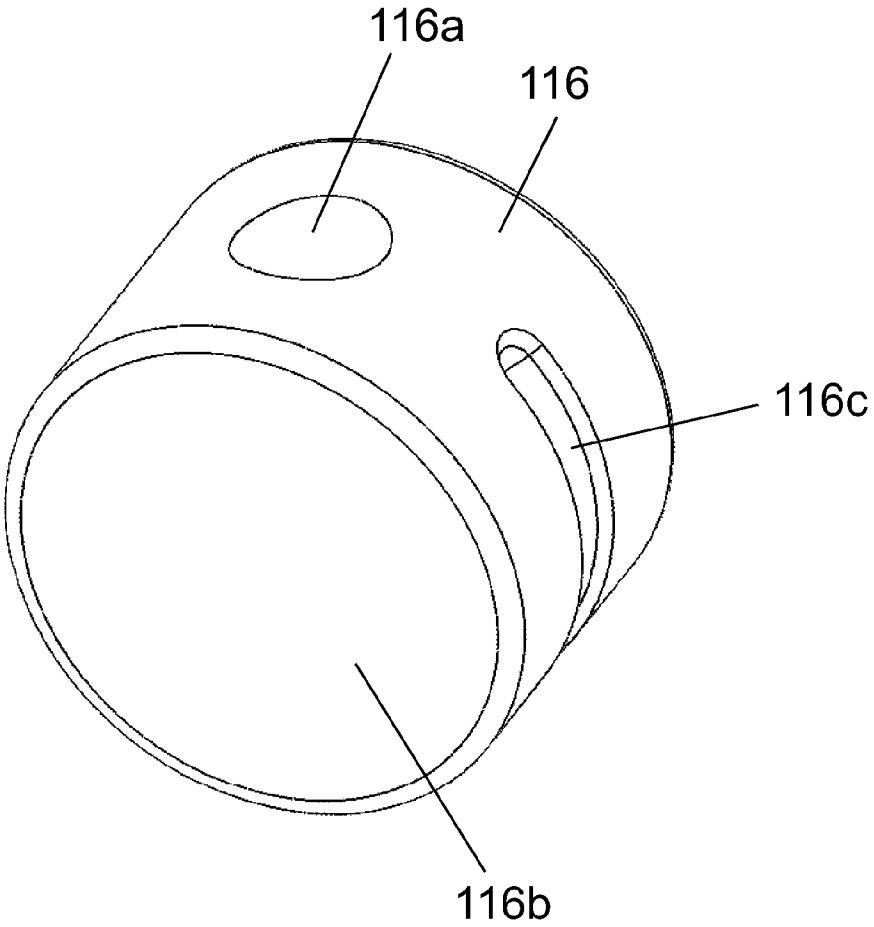
FIG. 38 is an isometric view of a threaded fork drum.
Figure 39:
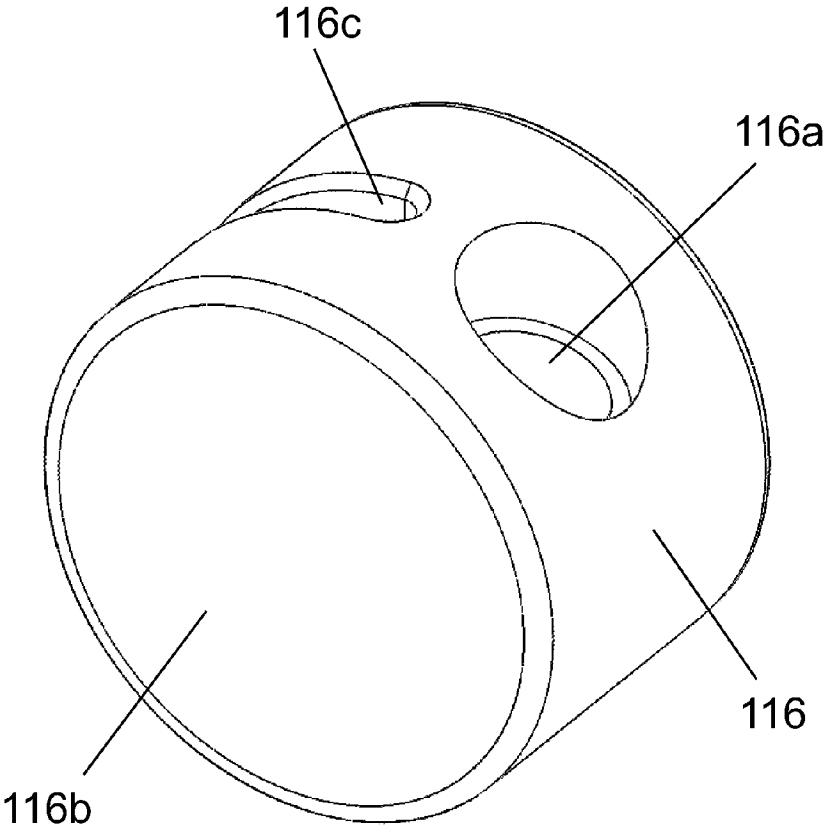
FIG. 39 is another isometric view of the threaded fork drum.
Figure 40:
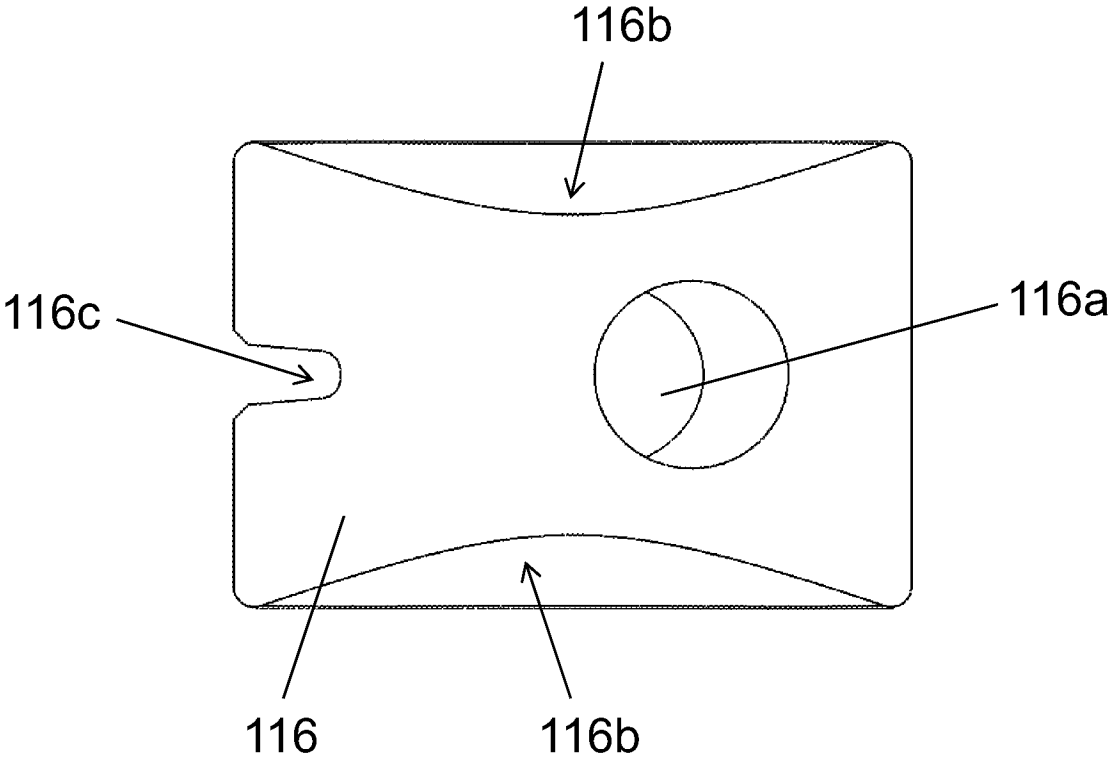
FIG. 40 is a cross-sectional view of the threaded fork drum.

As depicted in FIGS. 38-40, the cylindrical drum-like component ("drum") 116 has concave sides **116*b* with which to hold the drum between a finger and a thumb. As shown in FIGS. 38-40, the drum has recessed concave side surfaces. In other embodiments, the concave drum 116 may be replaced with another suitable rotating element that achieves the same or similar kinematics. The drum is encapsulated within a respective end member (slidable support member). The drum 116 has a bore 116*a* for the stem and an arcuate slot 116*c***.

FIGS. 41-46 depict a shoulder rest with a thumbscrew adjustment mechanism in accordance with another embodiment of the invention.

Figure 41:
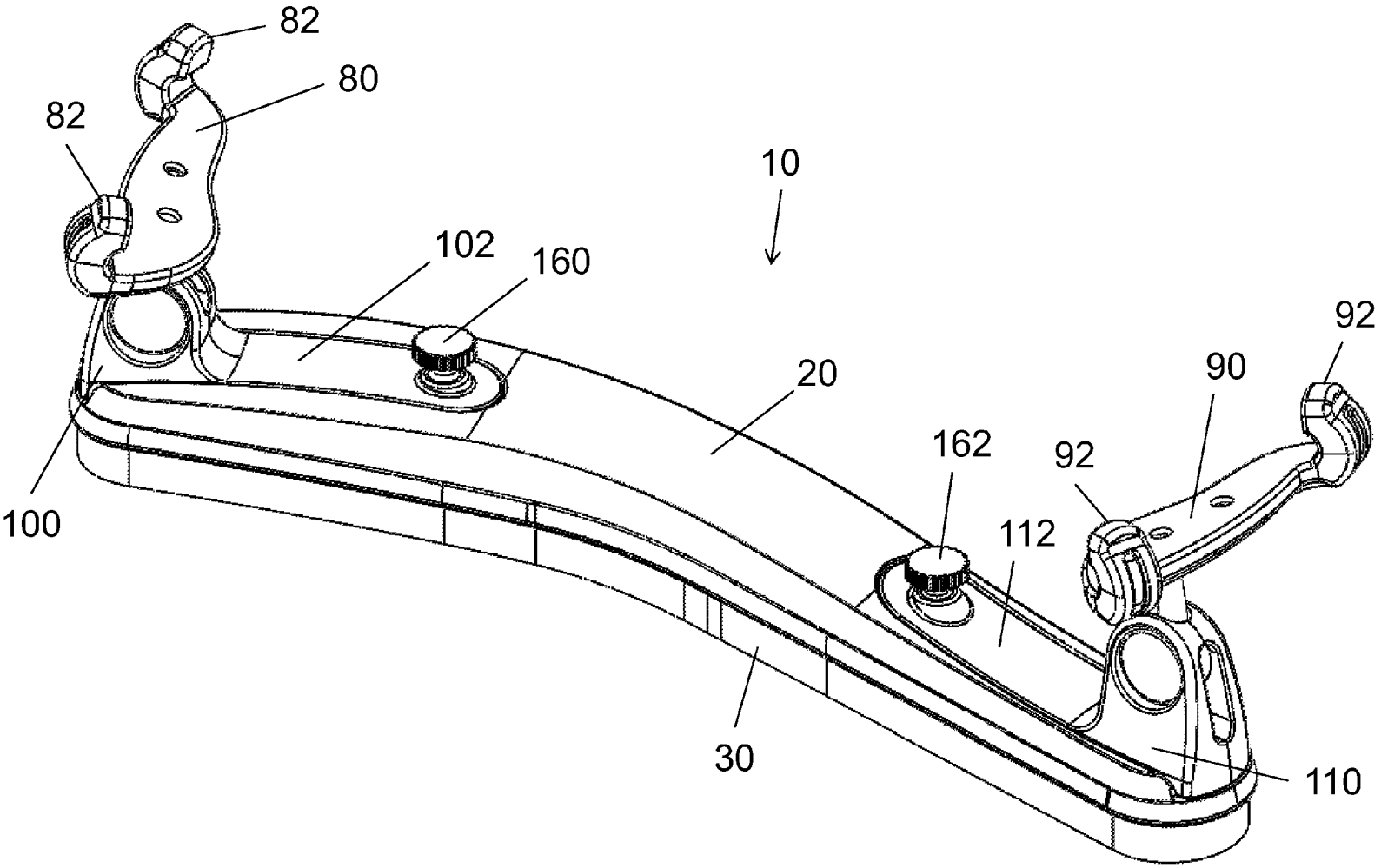
FIG. 41 is an isometric view of another embodiment of the shoulder rest having a thumbscrew.
Figure 42:
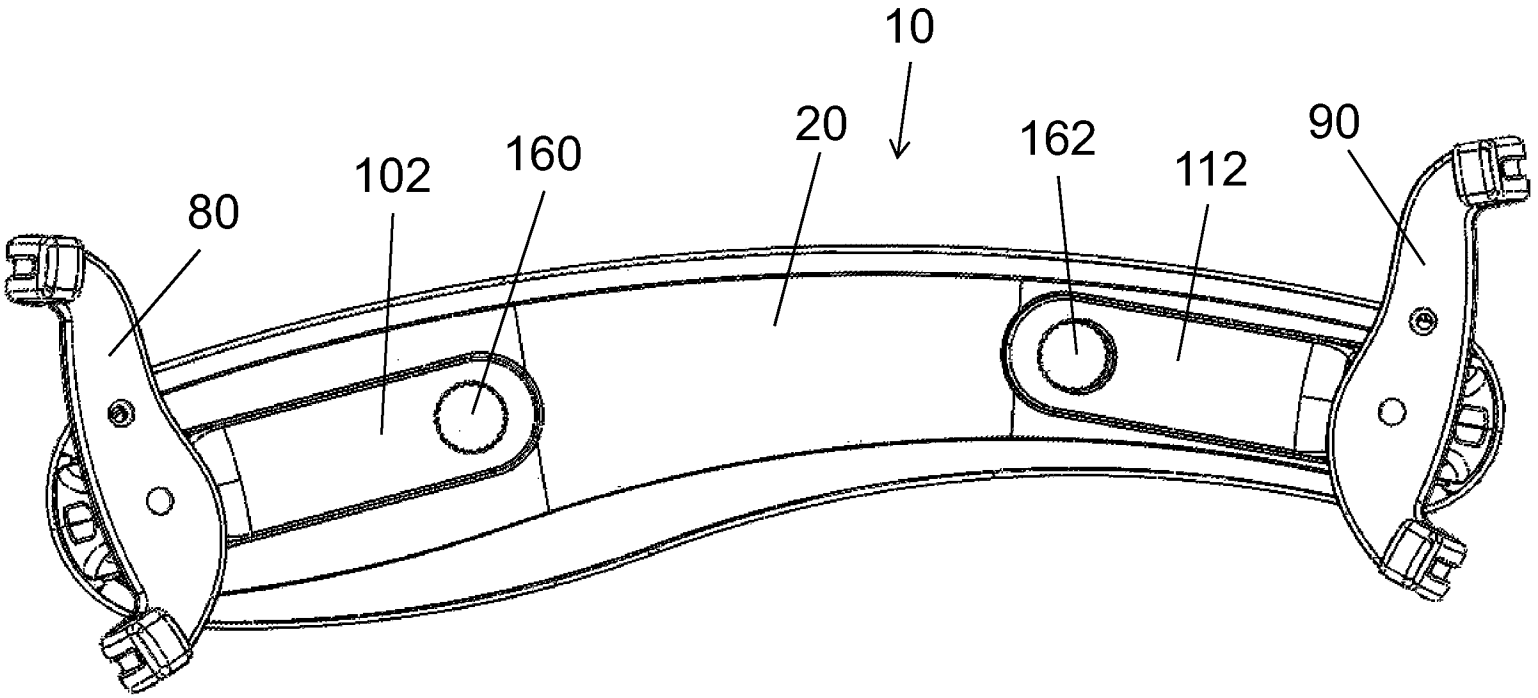
FIG. 42 is a top view of the shoulder rest of FIG. 41.
Figure 43:
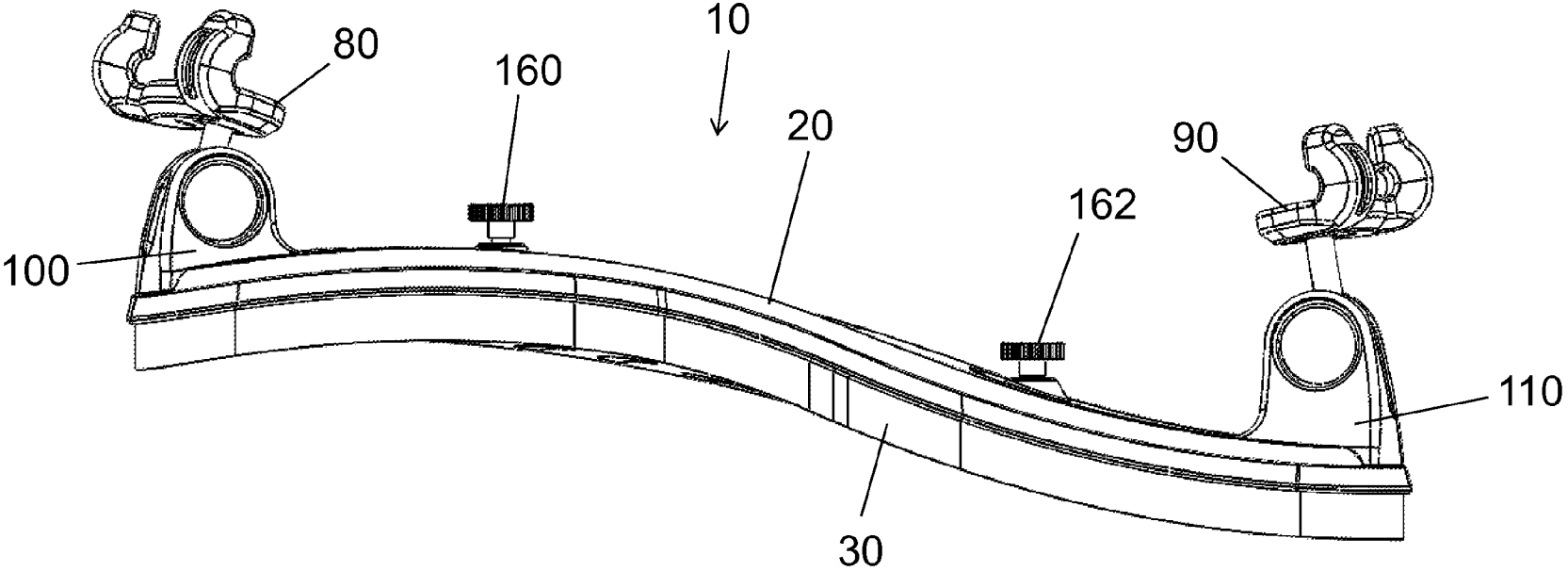
FIG. 43 is a side view of the shoulder rest of FIG. 41.

As depicted in FIGS. 41-43, the shoulder rest 10 has the same body 20 and foam cushion 30 as was described above. Likewise, the shoulder rest has one fork 80 (with tines, prongs or fingers 82) at the shoulder end and another fork 90 (with tines, prongs or fingers 92) at the clavicle end. The shoulder end member 100 has a tongue-shaped slider 102. The clavicle end member 110 has a tongue-shaped slider 112. A first thumbscrew 160 fastens the first tongue-shaped slider 102 in place on the shoulder end. Similarly, a second thumbscrew 162 fastens the second tongue-shaped slider 112 in place on the shoulder end. These thumbscrew adjustment mechanisms are an alternative to the pull-tab adjustment mechanisms described in the first embodiment.

Figure 44:
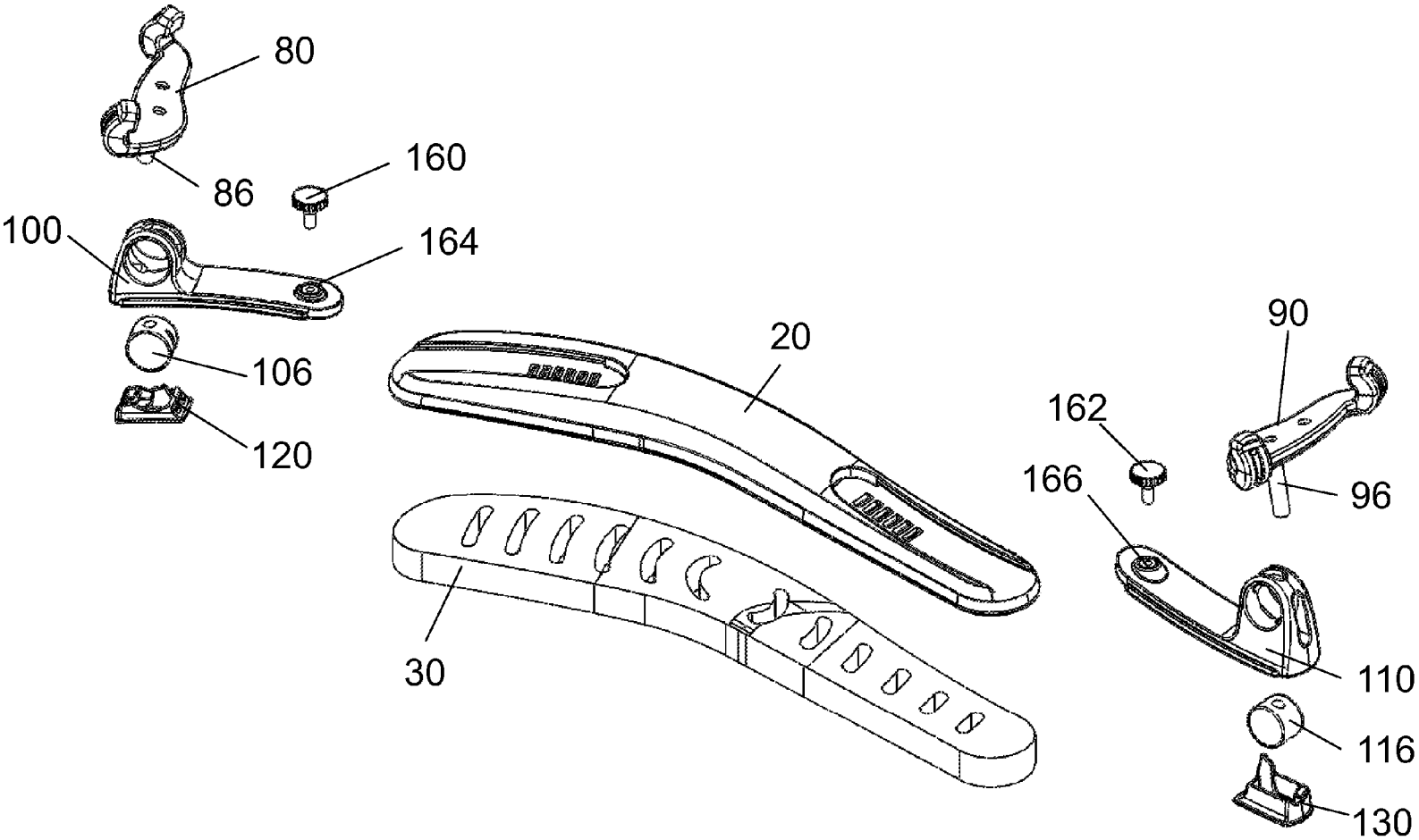
FIG. 44 is an exploded (assembly) view of the shoulder rest of FIG. 41.
Figure 45:
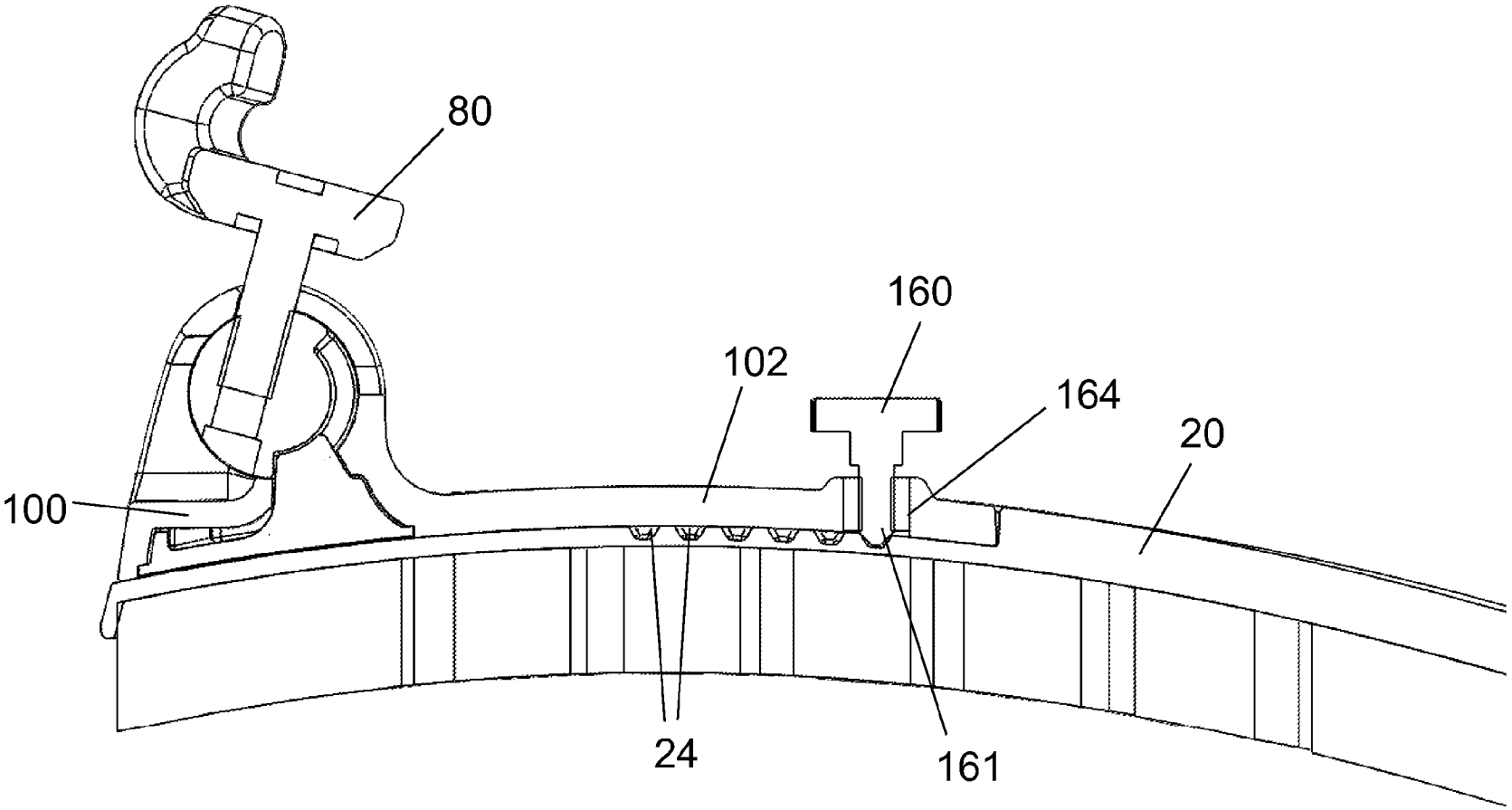
FIG. 45 is a side cross-sectional view of the shoulder end with the thumbscrew adjustment mechanism.
Figure 46:
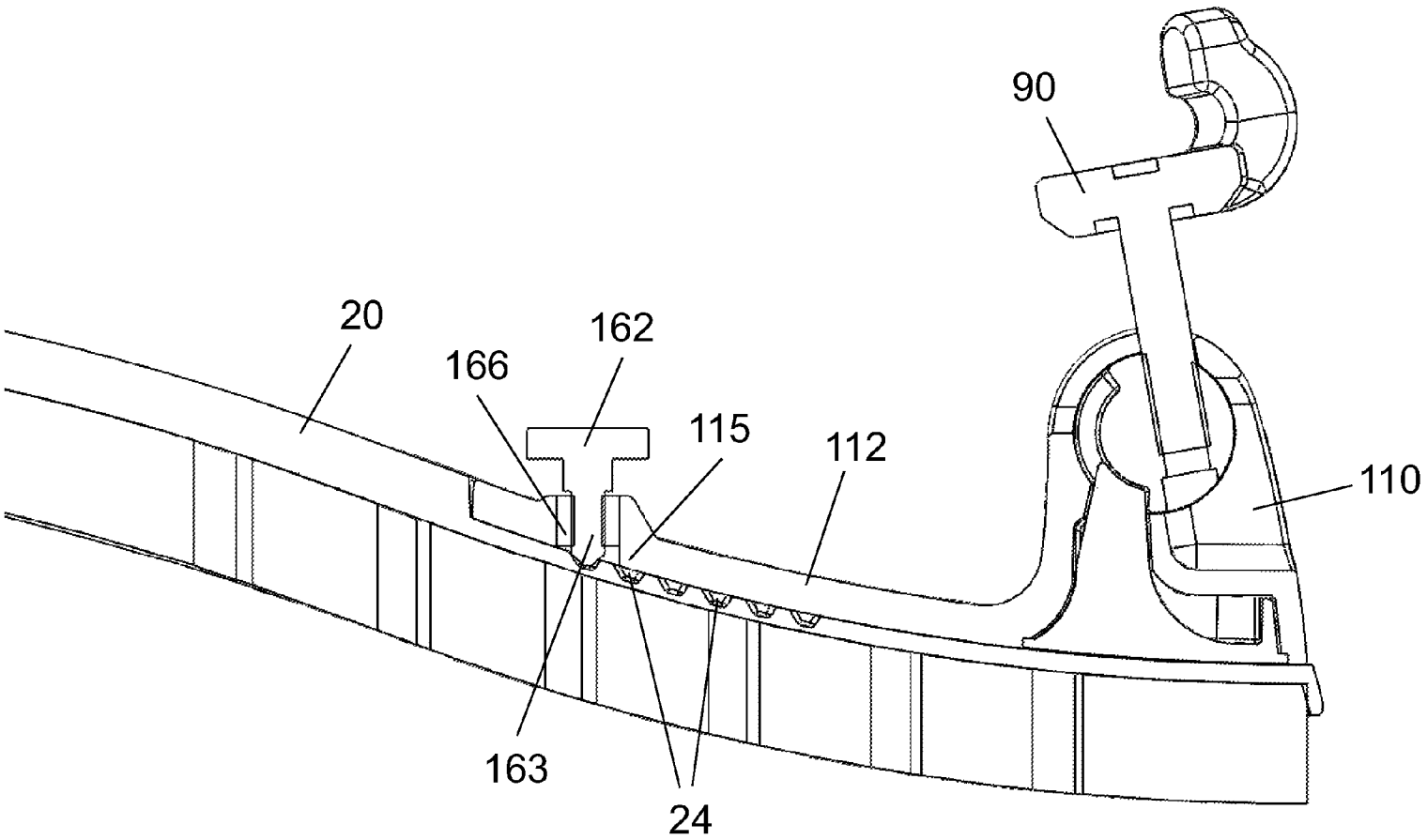
FIG. 46 is a side cross-sectional view of the clavicle end with the thumbscrew adjustment mechanism.

FIG. 44 shows how the shoulder rest is assembled by connecting the body 20 to the cushion/pad 30 and by encapsulating the drums 106, 116 within the end members 100, 110. The retainer cover plates 120, 130 hold the drums 106, 116 inside the bores of the end members 100, 110 as described previously. As illustrated in FIG. 44, the shoulder end member 100 has a threaded bore 164 into which the thumbscrew 160 is threaded. The clavicle end member 110 has a threaded bore 166 into which the thumbscrew 162 is threaded. As shown in FIG. 45, the tip 161 of the thumbscrew 160 protrudes into one of the plurality of apertures, e.g. transverse grooves to lock the slider 102 in place. Similarly, as shown in FIG. 46, the tip 163 of the thumbscrew 162 extends into one of the transverse grooves 24 to lock the slider 112 in place.

The embodiments of the invention described above are intended to be exemplary only. As will be appreciated by those of ordinary skill in the art, to whom this specification is addressed, many obvious variations, modifications, and refinements can be made to the embodiments presented herein without departing from the inventive concept(s) disclosed herein. The scope of the exclusive right sought by the applicant(s) is therefore intended to be limited solely by the appended claims.

The invention claimed is:

1. An adjustable and foldable shoulder rest for a musical instrument, the shoulder rest comprising:

a shoulder-engaging body having a first end and a second end, the body also having a shoulder-engaging side and an instrument-facing side;

a first foldable fork-shaped clamping member disposed at the first end for clamping the musical instrument, wherein the first clamping member is foldable from an unfolded position to a folded position;

a second foldable fork-shaped clamping member disposed at the second end for clamping the musical instrument wherein the second clamping member is foldable from an unfolded position to a folded position;

a first slidable end member for receiving a first threaded stem that supports the first clamping member, the first slidable end member being slidable between a retracted position and an extended position, the first slidable end member also having a first arcuate channel through which the first stem rotates as the first clamping member is pivoted between the unfolded and folded positions, wherein the first slidable end member is slidable within a first slot in the instrument-facing side of the body to extend or retract the first clamping member; and a second slidable end member for receiving a second threaded stem that supports the second clamping member, the second slidable end member being slidable between a retracted position and an extended position, the second slidable end member also having a second arcuate channel through which the second stem rotates as the second clamping member is pivoted between the unfolded and folded positions, wherein the second slidable end member is slidable within a second slot in the instrument-facing side of the body to extend or retract the second clamping member.

2. The shoulder rest of claim 1, wherein the first slidable end member in its extended position is cantilevered beyond the first slot.

3. The shoulder rest of claim 1, wherein the second slidable end member in its extended position is cantilevered beyond the second slot.

4. The shoulder rest of claim 2, wherein the second slidable end member in its extended position is cantilevered beyond the second slot.

5. The shoulder rest of claim 1, further comprising a foam cushion attached to the instrument-facing side of the body to provide a cushioned shoulder rest.

6. The shoulder rest of claim 5, wherein the foam cushion comprises a plurality of openings.

7. The shoulder rest of claim 1, wherein the first slidable end member comprises a cylindrical drum-like component having concave sides with which to hold the cylindrical drum-like component between a finger and a thumb.

8. The shoulder rest of claim 1, wherein the first and second clamping members are asymmetric.

9. A shoulder rest for a bowed string instrument, the shoulder rest comprising:

a shoulder-engaging body having a shoulder-engaging side and an instrument-facing side;

a first foldable fork for attaching to the instrument, wherein the first fork is foldable from an unfolded position to a folded position;

a second foldable fork for attaching to the instrument wherein the second fork is foldable from an unfolded position to a folded position;

a first slidable end member for receiving a first stem that supports the first fork, the first slidable end member being slidable between a retracted position and an extended, cantilevered position, the first slidable end member also having a first arcuate channel through which the first stem rotates as the first fork is pivoted between the unfolded and folded positions, wherein the first slidable end member is slidable within a first slot in the instrument-facing side of the body to extend or retract the first fork; and a second slidable end member for receiving a second stem that supports the second fork, the second slidable end member being slidable between a retracted position and an extended, cantilevered position, the second slidable end member also having a second arcuate channel through which the second stem rotates as the second fork is pivoted between the unfolded and folded positions, wherein the second slidable end member is slidable within a second slot in the instrument-facing side of the body to extend or retract the second fork.

10. The shoulder rest of claim 9, further comprising a foam cushion disposed on the shoulder-engaging side, the foam cushion comprising a plurality of openings.

11. The shoulder rest of claim 9, wherein the first slot is convex and the second slot is concave.

12. The shoulder rest of claim 9, wherein the first slidable end member rotationally houses a first drum that supports the first stem of the first fork and wherein the second slidable end member rotationally houses a second drum that supports the second stem of the second fork.

13. A shoulder rest for a musical instrument, the shoulder rest comprising:

a shoulder-engaging body having a first end and a second end, the body also having a shoulder-engaging side and an instrument-facing side;

a first foldable fork attachable to the musical instrument and foldable from an unfolded position to a folded position;

a second foldable fork attachable to the musical instrument and foldable from an unfolded position to a folded position;

a first slidable end member for receiving a first threaded stem that supports the first fork, the first slidable end member being slidable between a retracted position and an extended position extending beyond the first end, the first slidable end member also having a first arcuate channel through which the first stem rotates as the first fork is pivoted between the unfolded and folded positions, wherein the first slidable end member is slidable within a first slot in the instrument-facing side of the body to extend or retract the first fork; and a second slidable end member for receiving a second threaded stem that supports the second fork, the second slidable end member being slidable between a retracted position and an extended position extending beyond the second end, the second slidable end member also having a second arcuate channel through which the second stem rotates as the second fork is pivoted between the unfolded and folded positions, wherein the second slidable end member is slidable within a second slot in the instrument-facing side of the body to extend or retract the second fork.

14. The shoulder rest of claim 13, wherein the first slot is convex and the second slot is concave.

15. The shoulder rest of claim 13, wherein the first slidable end member rotationally houses a first drum that supports the first stem of the first fork and wherein the second slidable end member rotationally houses a second drum that supports the second stem of the second fork.

16. The shoulder rest of claim 13, further comprising a foam cushion disposed on the shoulder-engaging side.

17. The shoulder rest of claim 13, further comprising a foam cushion disposed on the shoulder-engaging side, the foam cushion comprising a plurality of openings.

* * * * *